US009429022B2

(12) United States Patent
Matsumoto et al.

(10) Patent No.: US 9,429,022 B2
(45) Date of Patent: Aug. 30, 2016

(54) STEAM TURBINE

(75) Inventors: Kazuyuki Matsumoto, Tokyo (JP); Yoshihiro Kuwamura, Tokyo (JP); Hiroharu Oyama, Tokyo (JP); Yoshinori Tanaka, Tokyo (JP); Yukinori Machida, Tokyo (JP); Asaharu Matsuo, Kobe (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 635 days.

(21) Appl. No.: 13/811,738

(22) PCT Filed: Sep. 15, 2011

(86) PCT No.: PCT/JP2011/071101
§ 371 (c)(1),
(2), (4) Date: Jan. 23, 2013

(87) PCT Pub. No.: WO2012/043254
PCT Pub. Date: Apr. 5, 2012

(65) Prior Publication Data

US 2013/0129493 A1 May 23, 2013

(30) Foreign Application Priority Data

Sep. 28, 2010 (JP) ..... 2010-217218

(51) Int. Cl.

| | |
|---|---|
| ***F01D 5/14*** | (2006.01) |
| ***F01D 5/12*** | (2006.01) |
| ***F01D 5/22*** | (2006.01) |
| ***F01D 11/00*** | (2006.01) |
| ***F01D 11/08*** | (2006.01) |

(52) U.S. Cl.
CPC ..... *F01D 5/12* (2013.01); *F01D 5/225* (2013.01); *F01D 11/001* (2013.01); *F01D 11/08* (2013.01)

(58) Field of Classification Search
None
See application file for complete search history.

(56) References Cited

U.S. PATENT DOCUMENTS 3,529,904 A 9/1970 Scalzo et al.
5,632,598 A * 5/1997 Maier ..... F01D 5/225 415/173.5

(Continued)

FOREIGN PATENT DOCUMENTS

| | | |
|---|---|---|
| EP | 2 031 189 | 3/2009 |
| GB | 1 221 229 | 2/1971 |

(Continued)

OTHER PUBLICATIONS

International Search Report issued Oct. 25, 2011 in International (PCT) Application No. PCT/JP2011/071101 with English translation.

(Continued)

*Primary Examiner* — Ninh H Nguyen
*Assistant Examiner* — Justin Seabe
(74) *Attorney, Agent, or Firm* — Wenderoth, Lind & Ponack, L.L.P.

(57) ABSTRACT

A turbine includes an annular turbine blade body disposed on a flow path, a diaphragm outer ring installed at a tip side of the annular turbine blade body via a clearance, and seal fins formed to protrude from the diaphragm outer ring and configured to form small clearances with the annular turbine blade body, wherein dead water region-filling sections are formed in cavities in which main vortexes are generated, such that a dead water region that the main vortexes cannot reach is filled.

13 Claims, 12 Drawing Sheets

(56) References Cited

U.S. PATENT DOCUMENTS

| | | | | |
|---|---|---|---|---|
| 6,168,377 | B1 | 1/2001 | Wolfe et al. | |
| 7,445,213 | B1 * | 11/2008 | Pelfrey | 277/418 |
| 2010/0074733 | A1 | 3/2010 | Little | |
| 2011/0280715 | A1 * | 11/2011 | Garg et al. | 415/174.5 |

FOREIGN PATENT DOCUMENTS

| | | |
|---|---|---|
| JP | 10-252412 | 9/1998 |
| JP | 10-311205 | 11/1998 |
| JP | 11-148307 | 6/1999 |
| JP | 11-200810 | 7/1999 |
| JP | 11-247618 | 9/1999 |
| JP | 2000-073702 | 3/2000 |
| JP | 2002-535563 | 10/2002 |
| JP | 2004-332616 | 11/2004 |
| JP | 2005-180278 | 7/2005 |
| JP | 2006-052808 | 2/2006 |
| JP | 2006-291967 | 10/2006 |
| JP | 2011-080452 | 4/2011 |
| JP | 2011-174451 | 9/2011 |
| JP | 2011-208602 | 10/2011 |

OTHER PUBLICATIONS

Written Opinion of the International Searching Authority issued Oct. 25, 2011 in International (PCT) Application No. PCT/JP2011/071101 with English translation.

Chinese Office Action issued May 20, 2014 in corresponding Chinese Patent Application No. 201180029455.0 with English translation.

Japanese Office Action issued Oct. 14, 2014 in corresponding Japanese Application No. 2010-217218 with English translation.

Korean Office Action issued Jan. 28, 2014 in corresponding Korean Patent Application No. 10-2012-7033665 with English translation.

Notice of Reasons for Rejection issued Oct. 20, 2015 in Japanese Application No. 2014-253503 (with English translation).

* cited by examiner

STEAM TURBINE

BACKGROUND OF THE INVENTION

1. Technical Field

The present invention relates to a turbine used in, for example, a power generation plant, a chemical plant, a gas plant, steelworks, a ship, or the like.

Priority is claimed on Japanese Patent Application No. 2010-217218, filed on Sep. 28, 2010, the content of which is incorporated herein by reference.

2. Background Art

In the related art, as one kind of a steam turbine, a steam turbine including a casing, a shaft body (rotor) rotatably installed in the casing, turbine vanes fixedly disposed at an inner circumferential section of the casing, and turbine blades radially installed at the shaft body in a downstream side of the turbine vanes, which are provided in a plurality of stages, is well-known. The steam turbine is generally classified as an impulse turbine or a reaction turbine according to a difference in operation type. In the impulse turbine, the turbine blades are rotated only by an impulsive force received from steam.

In the impulse turbine, the turbine vanes have a nozzle shape, steam passing through the turbine vanes is injected to the turbine blades, and the turbine blades are rotated only by an impulsive force received from the steam. Meanwhile, in the reaction turbine, the turbine vanes have the same shapes as the turbine blades, and the turbine blades are rotated by an impulsive force received from the steam passing through the turbine vanes and a reactive force with respect to expansion of the steam generated when passing through the turbine blades.

Here, in such a steam turbine, a clearance having a predetermined width in a radial direction is formed between tip sections of the turbine blades and the casing, and a clearance having a predetermined width in the radial direction is also formed between tip sections of the turbine vanes and the shaft body. Then, some of the steam flowing in an axial direction of the shaft body is leaked to a downstream side through the clearances with the tip sections of these turbine blades or the turbine vanes. Here, since the steam leaked downstream from the clearance between turbine blades and the casing applies neither the impulsive force nor the reactive force with respect to the turbine blades, the steam hardly contributes to a driving force to rotate the turbine blades regardless of the impulse turbine or the reaction turbine. In addition, since the steam leaked from the clearance between the turbine vanes and the shaft body to the downstream side is neither varied in velocity nor expanded even when passing over the turbine vanes, the steam hardly contributes to a driving force to rotate the turbine blades of the downstream side regardless of the impulse turbine or the reaction turbine. Accordingly, in order to improve performance of the steam turbine, it is important to reduce a leakage amount of the steam in the clearance with the tip sections of the turbine blade or the turbine vane.

Here, a seal fin is conventionally used as a means for preventing a leakage of the steam from the clearance with the tip sections of the turbine blades or the turbine vanes. For example, when the seal fin is used at the tip section of the turbine blade, the seal fin is installed to protrude from any one of the turbine blade and the casing and form a small clearance with the other.

In addition, in the steam turbine in the related art, it is known that a casing corner is formed in a curved shape in a cross-section in the axial direction such that a stress concentration is not generated due to thermal expansion or the like of the casing at a corner formed at a wall surface of the casing (for example, see FIG. 2 of Patent Document 1). Here, in general, the curved shape of the casing corner is formed in an arc shape having a radius of about 1 mm.

PRIOR ART DOCUMENTS

Patent Document

[Patent Document 1] Japanese Patent Application, First Publication No. 2000-073702

PROBLEMS TO BE SOLVED BY THE INVENTION

However, improvement in performance of the steam turbine is strongly needed, and a leakage amount of steam from a clearance between a blade body such as a turbine blade or the like and a structure such as a casing or the like should be further reduced.

SUMMARY OF THE INVENTION

In consideration of the above-mentioned circumstances, it is an object of the present invention to provide a high performance turbine capable of reducing a leakage amount of steam in a clearance with a tip section of a turbine blade or a turbine vane.

MEANS FOR SOLVING THE PROBLEMS

A turbine according to the present invention includes a blade disposed at a flow path through which a fluid flows, a structure installed at a tip side of the blade via a clearance and relatively rotated with respect to the blade, and a seal fin formed to protrude from any one of the blade and the structure and configured to form a small clearance with the other, wherein a dead water region-filling section is formed in a space formed by the blade, the structure and the seal fin and in which a vortex flow of the fluid is generated, such that a dead water region that the vortex flow cannot reach is filled.

According to the above-mentioned configuration, since the dead water region of the space is filled with the dead water region-filling section, energy loss due to introduction of the vortex flow generated in the space into the dead water region can be reduced. Accordingly, the vortex flow can be strengthened in comparison with the case in which the dead water region-filling section is not provided, a contraction flow effect is increased when the vortex flow has the contraction flow effect, and a leakage amount of the fluid in the clearance between a blade tip section and the structure can be reduced.

In addition, in the turbine according to the present invention, the dead water region-filling section has an inclined surface along the vortex flow of the fluid.

According to the above-mentioned configuration, since the vortex flow flows along the inclined surface of the dead water region-filling section configured to fill the dead water region of the space, the energy loss of the vortex flow in the dead water region can be securely reduced. Accordingly, the vortex flow can be further strengthened, the contraction flow effect is increased when the vortex flow has the contraction flow effect, and the leakage amount of the fluid can be further reduced.

In addition, in the turbine according to the present invention, the inclined surface is formed in a concave-shaped curve in a cross-section in an axial direction thereof.

According to the above-mentioned configuration, since the inclined surface of the dead water region-filling section can more accurately follow the vortex flow moving along a curved orbit, the energy loss of the vortex flow in the dead water region can be more securely reduced. Accordingly, the vortex flow can be further strengthened, the contraction flow effect is increased when the vortex flow has the contraction flow effect, and the leakage amount of the fluid can be further reduced.

In addition, in the turbine according to the present invention, the inclined surface is formed in a substantially linear shape in a cross-section in the axial direction thereof.

According to the above-mentioned configuration, the dead water region-filling section can be formed at the blade or the structure by simple processing or a simple mold shape.

In addition, in the turbine according to the present invention, the dead water region-filling section is formed at a corner of the space formed by an axial direction wall surface in an axial direction and a radial direction wall surface in a radial direction.

According to the above-mentioned configuration, since the dead water region-filling section is formed at the corner formed by the axial direction wall surface and the radial direction wall surface, generation of stress concentration in the corner of the blade or the structure due to thermal expansion or expansion due to a centrifugal force can be attenuated. Accordingly, damage to the blade or the structure due to the stress concentration can be prevented in advance.

In addition, in the turbine according to the present invention, a first seal fin formed at a furthest upstream side in the axial direction of the seal fin forms substantially the same surface as an axial direction end surface of the blade disposed at a furthest upstream section in the axial direction.

According to the above-mentioned configuration, since partial separation of the vortex flow is not generated at an angled section of the blade, the leakage amount of the fluid can be further reduced by the high contraction flow effect of the vortex flow itself, rather than the contraction flow effect of the separation vortex generated due to the separation.

In addition, in the turbine according to the present invention, the seal fin is formed to protrude from the blade, and the axial direction wall surface in the axial direction of the structure is formed to step down in the radial direction from the first seal fin at an upstream side portion rather than a downstream side portions thereof.

According to the above-mentioned configuration, since the seal fin protrudes from the blade side, the small clearance through which the fluid leaks is formed at a position near the structure. Then, since the axial direction wall surface of the structure is stepped down in the radial direction at the upstream side of the first seal fin, a pivot center of the vortex flow approaches closer to the small clearance in comparison with the case in which there is no step-down. Accordingly, since a radial direction velocity of the vortex flow near the small clearance is higher when the step-down is present than when there is no step-down, and the contraction flow effect of the vortex flow can be increased, the leakage amount of the fluid in the small clearance can be further reduced.

In addition, in the turbine according to the present invention, the axial direction wall surface in the axial direction of the structure has a level difference in the radial direction between a portion opposite to one of a pair of seal fins adjacent to each other in the axial direction and a portion opposite to the other.

According to the above-mentioned configuration, in the space formed between a pair of seal fins adjacent to each other, as the vortex flow is separated at a stepped angled section, the separation vortex is generated at a downstream side of the vortex flow with respect to the angled section as a boundary. Then, the leakage amount of the fluid in the clearance between the seal fin and the structure at the downstream side can be reduced by the contraction flow effect of the separation vortex.

EFFECT OF THE INVENTION

According to the turbine of the present invention, a leakage amount of a fluid in a clearance between the blade tip section and the structure can be reduced.

MODES FOR CARRYING OUT THE INVENTION

First Embodiment

Hereinafter, embodiments of the present invention will be described with reference to the accompanying drawings.

Figure 1:
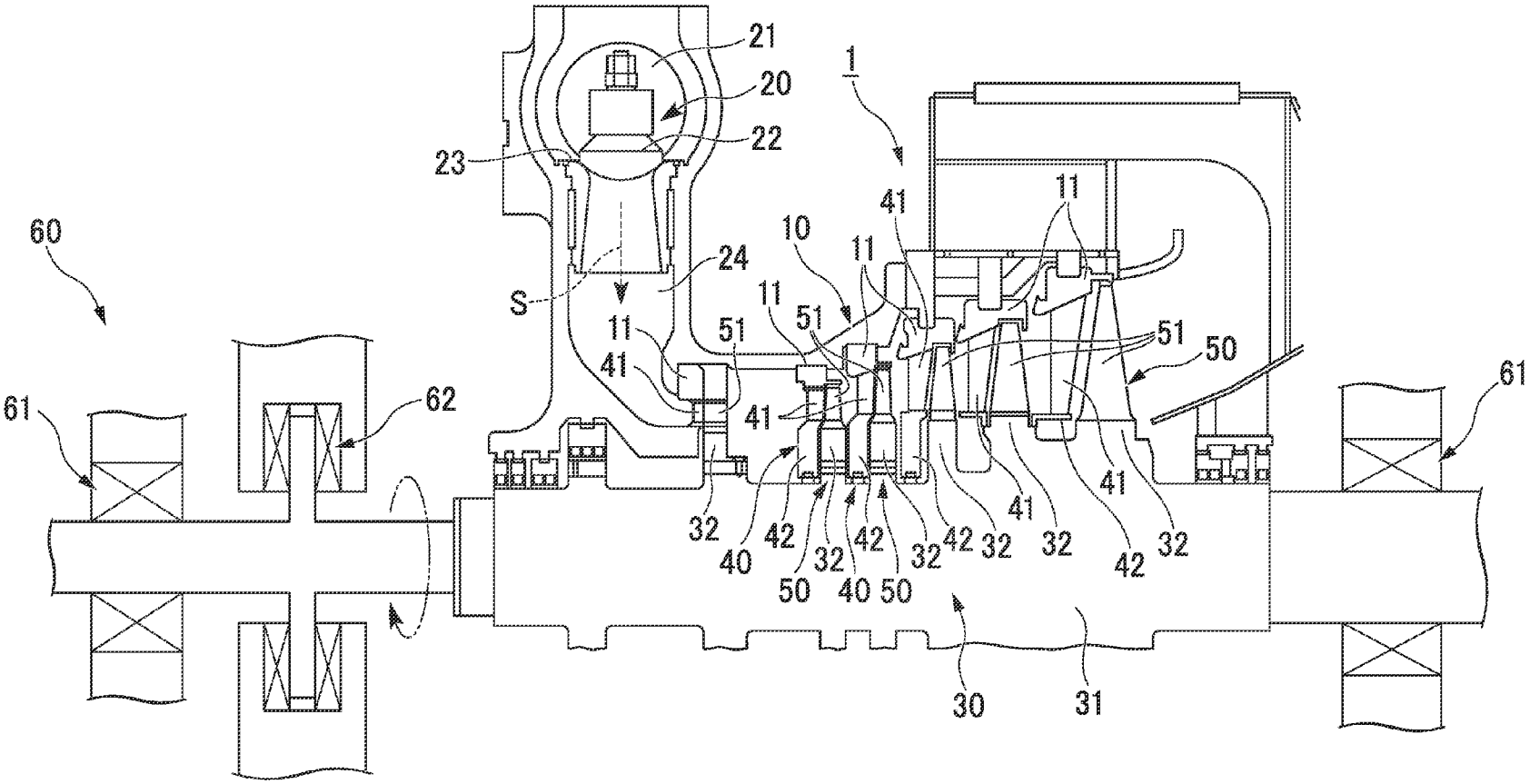
FIG. 1 is a schematic cross-sectional view showing a steam turbine according to a first embodiment of the present invention.

First, a configuration of a steam turbine according to a first embodiment of the present invention will be described. FIG. 1 is a schematic cross-sectional view showing a steam turbine 1 according to the first embodiment.

The steam turbine 1 includes a hollow casing 10, a regulating valve 20 configured to adjust an amount and a pressure of steam S (fluid) flowing into the casing 10, a shaft body 30 rotatably installed in the casing 10 and configured to transmit power to a machine such as a power generator or the like (not shown), an annular turbine vane group 40 held in the casing 10, an annular turbine blade group 50 (a blade) installed at the shaft body 30, and a bearing 60 configured to rotatably support the shaft body 30 about an axis thereof.

The casing 10 has an inner space, which is hermetically sealed, and functions as a flow path of the steam S. A ring-shaped diaphragm outer ring 11 (a structure) into which the shaft body 30 is inserted is securely fixed to an inner wall surface of the casing 10.

The plurality of regulating valves 20 are disposed in the casing 10, each of the regulating valves 20 includes a regulating valve chamber 21 into which steam S flows from a boiler (not shown), a valve body 22, and a valve seat 23, a steam flow path is opened when the valve body 22 is separated from the valve seat 23, and the steam S flows into the inner space of the casing 10 via a steam chamber 24.

The shaft body 30 includes a shaft body 31 and a plurality of discs 32 extending in a radial direction from an outer circumference of the shaft body 31. The shaft body 30 is configured to transmit rotational energy to a machine such as a power generator or the like (not shown).

The annular turbine vane group 40 includes a plurality of turbine vanes 41 installed to surround the shaft body 30 at predetermined intervals in a circumferential direction and having base end sections held by the diaphragm outer rings 11, and a ring-shaped hub shroud 42 configured to connect radial direction tip sections of the turbine vanes 41 to each other in the circumferential direction. Then, the shaft body 30 is inserted into the hub shroud 42 to form a clearance having a predetermined width in the radial direction.

Then, six annular turbine vane groups 40 having the above-mentioned configuration are installed at predetermined intervals in the axial direction of the shaft body 30, and pressure energy of the steam S is converted into velocity energy to be guided toward a turbine blade 51 adjacent to a downstream side thereof.

The bearing 60 has a journal bearing apparatus 61 and a thrust bearing apparatus 62, and rotatably supports the shaft body 30.

The annular turbine blade group 50 has a plurality of turbine blades 51 installed to surround the shaft body 30 at predetermined intervals in the circumferential direction and having base end sections thereof fixed to the disc 32, and a ring-shaped tip shroud (not shown in FIG. 1) configured to connect the radial direction tip sections of the turbine blades 51 to each other in the circumferential direction.

Then, six annular turbine blade groups 50 having the above-mentioned configuration are installed to be adjacent to downstream sides of the six annular turbine vane groups 40. Accordingly, the annular turbine vane groups 40 and the annular turbine blade groups 50, in which one set constitutes one stage, are provided to a total of six stages in the axial direction.

Figure 2:
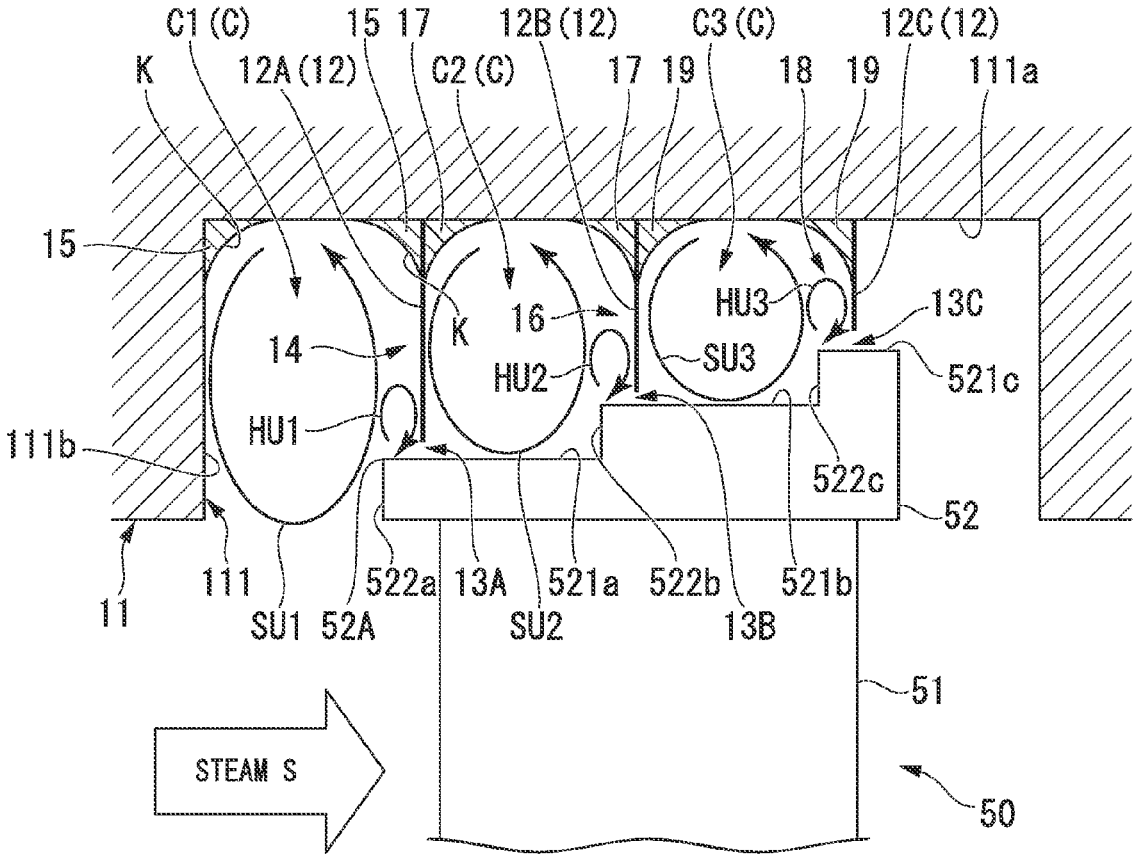
FIG. 2 is a partially enlarged cross-sectional view showing surroundings of a tip section of a turbine blade of FIG. 1.

Here, FIG. 2 is a partially enlarged cross-sectional view showing surroundings of a tip section of the turbine blade 51 in FIG. 1. A ring-shaped tip shroud 52 is disposed at the tip section of the turbine blade 51 as described above. The tip shroud 52 has a stepped cross-sectional shape, and includes three axial direction wall surfaces 521*a*, 521*b* and 521*c* in the axial direction and three radial direction wall surfaces 522*a*, 522*b* and 522*c* in the radial direction. In addition, a cross-sectional shape of the tip shroud 52 is not limited to the embodiment but a design thereof may be appropriately changed.

Meanwhile, an annular groove 111 having a concave cross-sectional shape is formed at an inner circumferential surface of the diaphragm outer ring 11 shown in FIG. 2. Then, three seal fins 12 are formed at a bottom surface 111*a* of the annular groove to protrude in the radial direction.

Here, among the three seal fins 12, a first seal fin 12A disposed at the furthest upstream side in a flow direction of the steam, i.e., the axial direction, is formed at a slight downstream side of a radial direction wall surface 522*a* of the tip shroud 52, and a small clearance 13A is formed in the radial direction between a tip thereof and an axial direction wall surface 521*a* of the tip shroud 52. In addition, among the three seal fins 12, a second seal fin 12B disposed at a second upstream side is formed at a slight downstream side of a radial direction wall surface 522*b* of the tip shroud 52, and a small clearance 13B is also formed in the radial direction between a tip thereof and an axial direction wall surface 521*b* of the tip shroud 52. Further, among the three seal fins 12, a third seal fin 12C disposed at the furthest downstream side is formed at a slight downstream side of a radial direction wall surface 522*c* of the tip shroud 52, and a small clearance 13C is also formed in the radial direction between a tip thereof and an axial direction wall surface 521*c* of the tip shroud 52. The seal fins 12 having the above-mentioned configuration have lengths reduced in a sequence of the first seal fin 12A, the second seal fin 12B, and the third seal fin 12C.

In addition, a length, a shape, an installation position or the number of the seal fins 12 is not limited to the embodiment but may be appropriately design-changed according to a cross-sectional shape of the tip shroud 52 and/or the diaphragm outer ring 11. Further, a dimension of the small clearance 13 is appropriately set to a minimum value within a safe range in which the seal fin 12 is not in contact with the tip shroud 52 in consideration of a thermal expansion amount of the casing 10 or the turbine blade 51, a centrifugal expansion amount of the turbine blade, or the like. In the embodiment, while all of the three small clearances 13 are set to have the same dimensions, according to necessity, the small clearances 13 may be set to have different dimensions according to the seal fins 12.

In addition, in the embodiment, while the seal fin 12 is installed to protrude from the diaphragm outer ring 11 and the small clearance 13 is formed between the seal fin 12 and the tip shroud 52, the seal fin 12 may also be formed to protrude from the tip shroud 52 and the small clearance 13 may be formed between the seal fin 12 and the diaphragm outer ring 11.

Then, according to a configuration of surroundings of a tip section of the turbine blade 51, as shown in FIG. 2, three cavities C (spaces) are formed by the diaphragm outer ring 11, the seal fin 12 and the tip shroud 52.

Here, among the three cavities C, a first cavity C1 disposed at the furthest upstream side in the axial direction is formed by, as shown in FIG. 2, the bottom surface 111*a* and a side surface 111*b* of the annular groove 111, the first seal fin 12A, and the radial direction wall surface 522*a* and the axial direction wall surface 521*a* of the tip shroud 52. The first cavity C1 as configured above has a substantially rectangular cross-section in the axial direction. However, a widened section 14 slightly widened in the axial direction is formed at a downstream section in an axial direction of the first cavity C1 to an extent to which the first seal fin 12A as configured above is formed at a slight downstream side of the radial direction wall surface 522*a*.

Then, as shown in FIG. 2, dead water region-filling sections 15 are formed at two corners of the first cavity C1, more specifically, a corner formed by the bottom surface 111*a* and the side surface 111*b* of the annular groove 111, and a corner formed by the bottom surface 111*a* of the annular groove 111 and the first seal fin 12A. The two dead water region-filling sections 15 are provided to bury and remove dead water regions formed at the corners of the first cavity C1, and have an inclined surface K formed in a concave-shaped curve in a cross-section in the axial direction. As described above, the concave-shaped curve has a shape along a vortex flow of the steam S generated in the first cavity C1, and has an arc shape having a radius of 5 mm or more in the embodiment. Accordingly, a size of the dead water region-filling section 15 becomes larger by about 25 times in a cross-sectional area ratio in comparison with an arc-shaped portion having a radius of about 1 mm and formed at the corner of the casing to prevent stress concentration as described above.

However, in the embodiment, while the dead water region-filling section 15 is constituted by a separate member from the diaphragm outer ring 11, the dead water region-filling section 15 may be integrally formed with the diaphragm outer ring 11. In addition, an installation position of the dead water region-filling section 15 is not limited to the corner of the first cavity C1 but may be an arbitrary position at which the dead water region is generated in the first cavity C1. Further, a shape of the inclined surface K may have an arbitrary shape according to a shape of the vortex flow of the steam S as well as the arc shape of the embodiment.

In addition, among the three cavities C, a second cavity C2 disposed at a second upstream side in the axial direction is formed by, as shown in FIG. 2, the bottom surface 111*a* of the annular groove 111, the first seal fin 12A, the axial direction wall surfaces 521*a* and 521*b* and the radial direction wall surface 522*b* of the tip shroud 52, and the second seal fin 12B. Then, a widened section 16 slightly widened in the axial direction is also formed at the downstream section in the axial direction of the second cavity C2, similar to the first cavity C1. Further, dead water region-filling sections 17 are also formed at two corners of the second cavity C2, more specifically, a corner formed by the bottom surface 111*a* of the annular groove 111 and the first seal fin 12A and a corner formed by the bottom surface 111*a* of the annular groove 111 and the second seal fin 12B. Functions and shapes of the two dead water region-filling sections 17 are the same as those of the dead water region-filling section 15 of the first cavity C1.

In addition, among the three cavities C, a third cavity C3 disposed at the furthest downstream side in the axial direction is formed by, as shown in FIG. 2, the bottom surface 111*a* of the annular groove 111, the second seal fin 12B, the axial direction wall surfaces 521*b* and 521*c* and the radial direction wall surface 522*c* of the tip shroud 52, and the third seal fin 12C. Then, a widened section 18 slightly widened in the axial direction is also formed at the axial direction downstream section of the third cavity C3, similar to the first cavity C1. Further, dead water region-filling sections 19 are also formed at two corners of the third cavity C3, more specifically, a corner formed by the bottom surface 111*a* of the annular groove 111 and the second seal fin 12B and a corner formed by the bottom surface 111*a* of the annular groove 111 and the third seal fin 12C. Functions and shapes of the two dead water region-filling sections 19 are the same as those of the dead water region-filling section 15 of the first cavity C1.

Next, effects of the steam turbine 1 according to the first embodiment will be described using FIGS. 1 and 2. When the regulating valve 20 shown in FIG. 1 is in an open state, the steam S flows into the casing 10 from the boiler (not shown). The steam S is guided to the annular turbine blade group 50 by the annular turbine vane group 40 of each stage, and the annular turbine blade group 50 starts to rotate. Accordingly, energy of the steam S is converted into rotational energy by the annular turbine blade group 50, and the rotational energy is transmitted to a power generator or the like (not shown) from the shaft body 30 integrally rotated with the annular turbine blade group 50.

Here, as shown in FIG. 2, some of the steam S passing through the annular turbine vane group 40 passes through the small clearance 13 between the seal fin 12 and the annular turbine blade group 50 to be leaked to the downstream side without contributing to rotation driving of the annular turbine blade group 50.

Leakage of the steam S will be described in more detail. As shown in FIG. 2, some of the steam S passing through the annular turbine vane group 40 and flowing in the axial direction flows into the first cavity C1 without colliding with the turbine blade 51. The steam S flowing into the first cavity C1 collides with the radial direction wall surface 522*a* of the tip shroud 52 to form, for example, a main counterclockwise vortex SU1 (a vortex flow) in FIG. 2. Accordingly, as some of the main vortex SU1 is separated therefrom at an angled section 52A of the tip shroud 52, a separation vortex HU1 (a vortex flow) in a reverse direction of the main vortex SU1, i.e., a clockwise direction of FIG. 2, is generated in the widened section 14 of the first cavity C1. The separation vortex HU1 shows a so-called contraction flow effect of reducing a leakage amount of the steam S in the small clearance 13A between the first seal fin 12A and the tip shroud 52.

Figure 3:
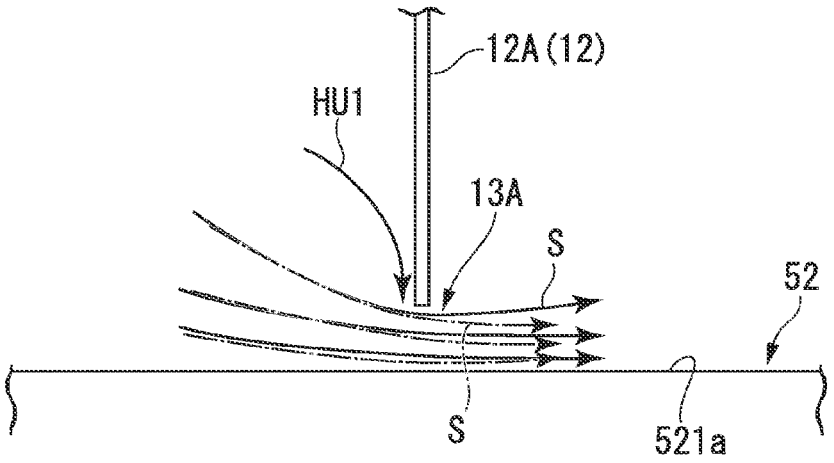
FIG. 3 is a view describing a contraction flow effect of a separation vortex, a partially enlarged cross-sectional view showing surroundings of a tip section of a first seal fin in FIG. 2.

Here, FIG. 3 is a view for describing the contraction flow effect of the separation vortex HU1, showing a partially enlarged cross-sectional view of surroundings of a tip section of the first seal fin 12A of FIG. 2. The separation vortex HU1 in a clockwise direction has an inertial force inward in the radial direction just before the small clearance 13A between the first seal fin 12A and the tip shroud 52. Accordingly, as the steam S leaked to the downstream side through the small clearance 13A is pushed thereinto by an inertial force of the separation vortex HU1, a width in the radial direction is reduced as shown by a dashed line of FIG. 3. As described above, the separation vortex HU1 has an effect of reducing a leakage amount by pushing and reducing the steam S inward in the radial direction, i.e., the contraction flow effect. In addition, the contraction flow effect is increased as the inertial force of the separation vortex HU1 is increased, i.e., a flow velocity of the separation vortex HU1 is increased.

Further, as shown in FIG. 2, the dead water region-filling sections 15 having substantial arc shapes are formed along a flow of the main vortex SU1 at two corners of the first cavity C1. Accordingly, the dead water region, i.e., a region that the main vortex SU1 does not reach, is not formed at the corner of the first cavity C1. Accordingly, as the steam S forming the main vortex SU1 flows into the dead water region, energy loss of the steam S can be prevented. As a result, since the main vortex SU1 can be strengthened, the separation vortex HU1 separated from the main vortex SU1 can also be strengthened. Accordingly, as the contraction flow effect of the separation vortex HU1 is increased in comparison with the case in which the dead water region-filling section 15 is not provided, the leakage amount of the steam S in the small clearance 13A between the first seal fin 12A and the tip shroud 52 can be reduced.

In addition, as shown in FIG. 2, the steam S leaked from the small clearance 13A flows into the second cavity C2. The steam S collides with the radial direction wall surface 522*b* of the tip shroud 52 to form a main vortex SU2 in a counterclockwise direction. Then, some of the main vortex SU2 is separated therefrom, and a separation vortex HU2 in a clockwise direction is generated in the widened section 16 of the second cavity C2. Similar to the separation vortex HU1, the separation vortex HU2 also shows the contraction flow effect of reducing the leakage amount of the steam S in the small clearance 13B between the second seal fin 12B and the tip shroud 52.

Further, as shown in FIG. 2, even in the second cavity C2, the dead water region-filling sections 17 having substantial arc shapes are formed at the two corners. Accordingly, similar to the dead water region-filling section 15 of the first cavity C1, the main vortex SU2 can be strengthened, and as a result, the separation vortex HU2 can also be strengthened. Accordingly, in comparison with the case in which the dead water region-filling section 17 is not provided, the contraction flow effect of the separation vortex HU2 can be increased, and the leakage amount of the steam S in the small clearance 13B can be reduced.

In addition, as shown in FIG. 2, the steam S leaked from the small clearance 13B flows into the third cavity C3. The steam S collides with the radial direction wall surface 522*c* of the tip shroud 52 to form a main vortex SU3 in a counterclockwise direction. Then, as some of the main vortex SU3 is separated therefrom, in the widened section 18 of the third cavity C3, a separation vortex HU3 in a clockwise direction is generated. Similar to the separation vortex HU1, the separation vortex HU3 also shows the contraction flow effect of reducing the leakage amount of the steam S in the small clearance 13C between the third seal fin 12C and the tip shroud 52.

Further, as shown in FIG. 2, in the third cavity C3, the dead water region-filling sections 19 having substantial arc shapes are formed at the two corners. Accordingly, similar to the dead water region-filling section 15 of the first cavity C1, the main vortex SU3 can be strengthened, and as a result, the separation vortex HU3 can also be strengthened. Accordingly, in comparison with the case in which the dead water region-filling section 19 is not provided, the contraction flow effect of the separation vortex HU3 can be increased, and the leakage amount of the steam S in the small clearance 13C can be reduced.

As described above, as the leakage amount of the steam S can be reduced by the contraction flow effect of the separation vortexes HU1, HU2 and HU3 in the three cavities C1, C2 and C3, respectively, the leakage amount of the steam S can be suppressed to be minimal. In addition, the number of cavities C in the axial direction is not limited to three cavities but an arbitrary number of cavities may be formed. Further, in the embodiment, while the dead water region-filling section 15 is installed in the first cavity C, the dead water region-filling section 17 is installed in the second cavity C2 and the dead water region-filling section 19 is installed in the third cavity C3, installation of the dead water region-filling sections in all of the cavities C is not needed, and installation of the dead water region-filling sections in at least one cavity C is sufficient.

Second Embodiment

Next, a configuration of a steam turbine according to a second embodiment of the present invention will be described. The steam turbine according to the embodiment is distinguished from the steam turbine 1 of the first embodiment in that the dead water region-filling section is formed at a different position in the cavity C formed at surroundings of a tip section of the moving blade 51. Since the other constitutions are the same as those of the first embodiment, the same reference numerals are designated and description thereof will be omitted.

Figure 4:
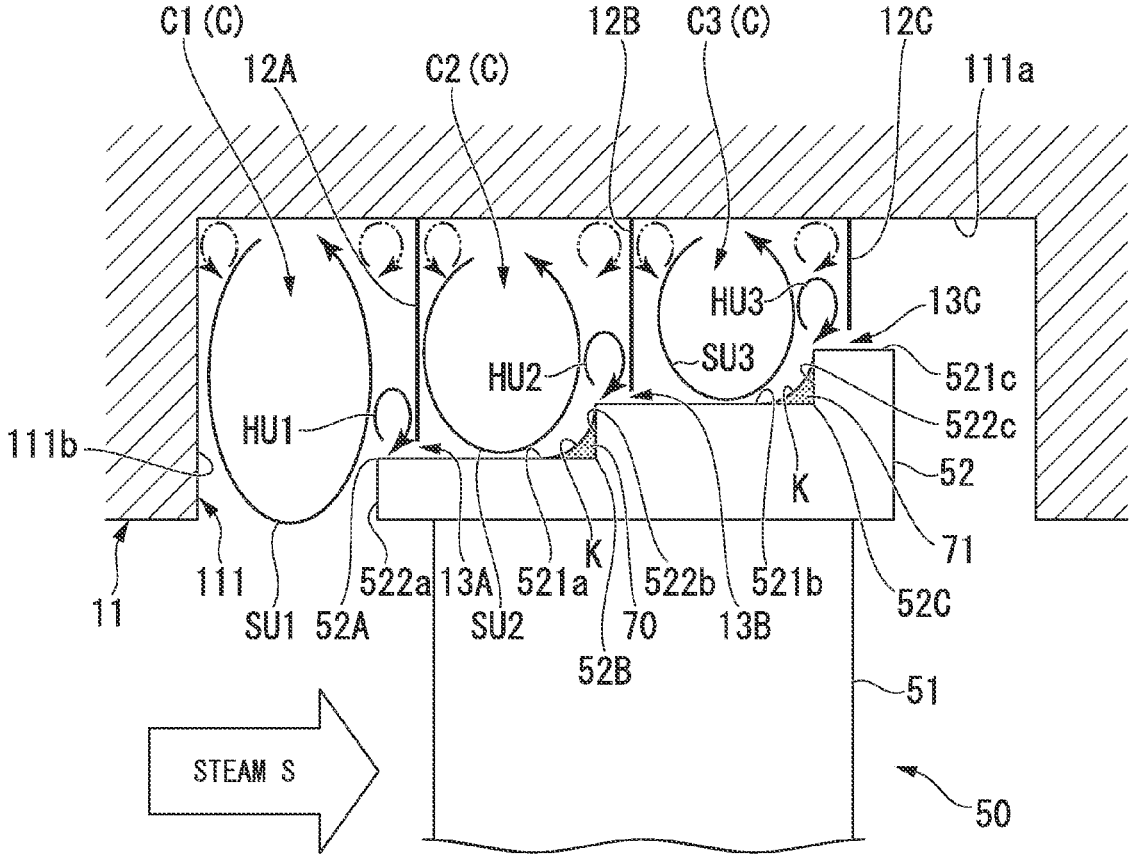
FIG. 4 is a schematic cross-sectional view showing surroundings of a tip section of a turbine blade of a second embodiment.

FIG. 4 is a schematic cross-sectional view showing surroundings of a tip section of the turbine blade 51 of the second embodiment. Similar to the first embodiment, the three cavities C are formed between the annular turbine blade group 50 and the diaphragm outer ring 11. Then, among the three cavities C, dead water region-filling section is not formed in the first cavity C1 disposed at the furthest upstream side in the axial direction. In addition, in FIG. 4, same constitutions in the first embodiment are designated by same reference numerals of FIG. 2.

Further, as shown in FIG. 4, among the three cavities C, a dead water region-filling section 70 is formed at one corner of the second cavity C2 disposed at a second upstream side in the axial direction. The dead water region-filling section 70 has the inclined surface K having a substantial arc shape in a cross-section in the axial direction, and is formed at a corner formed by the axial direction wall surface 521*a* and the radial direction wall surface 522*b* of the tip shroud 52.

In addition, as shown in FIG. 4, among the three cavities C, a dead water region-filling section 71 is formed at one corner of the third cavity C3 disposed at the furthest downstream side in the axial direction. The dead water region-filling section 71 also has an inclined surface K having a substantial arc shape, and is formed at a corner formed by the axial direction wall surface 521*b* and the radial direction wall surface 522*c* of the tip shroud 52.

Next, effects of the steam turbine 1 according to the second embodiment will be described focusing on differences from the first embodiment. According to the configuration shown in FIG. 4, the steam S leaked to the downstream side through the small clearance 13A between the first seal fin 12A and the tip shroud 52 forms the main vortex SU2 and the separation vortex HU2 when flowing into the second cavity C2, similar to the first embodiment. Then, the separation vortex HU2 shows a contraction flow effect of reducing a leakage amount of the steam S in the small clearance 13B.

Further, as shown in FIG. 4, the dead water region-filling section 70 having the substantially arc-shaped inclined surface K is formed at one corner of the second cavity C2. Accordingly, since the main vortex SU2 can be strengthened by preventing energy loss of the steam S in the dead water region, the separation vortex HU2 can also be resultantly strengthened. Accordingly, in comparison with the case in which the dead water region-filling section 70 is not provided, the contraction flow effect of the separation vortex HU2 can be increased, and the leakage amount of the steam S in the small clearance 13B can be reduced.

In addition, in the embodiment, the dead water region-filling section 70 is formed at a corner formed by the axial direction wall surface 521*a* and the radial direction wall surface 522*b* of the tip shroud 52. Accordingly, in angled sections 52B and 52C of the tip shroud 52 formed by the axial direction wall surface 521*a* and the radial direction wall surface 522*b* and having an acute shape, generation of stress concentration due to thermal expansion or expansion due to a centrifugal force can be attenuated.

Further, as shown in FIG. 4, in one corner of the third cavity C3, the dead water region-filling section 71 having the substantially arc-shaped inclined surface K is formed. Accordingly, since the separation vortex HU3 can be strengthened by strengthening the main vortex SU3, in comparison with the case in which the dead water region-filling section 71 is not provided, the leakage amount of the steam S in the small clearance 13C can be reduced. In addition, the dead water region-filling section 71 can be formed at a corner formed by the axial direction wall surface 521*b* and the radial direction wall surface 522*c* of the tip shroud 52. Accordingly, in the angled sections 52B and 52C of the tip shroud 52 having an acute shape, generation of stress concentration due to thermal expansion or expansion due to a centrifugal force can be attenuated.

Third Embodiment

Next, a configuration of a steam turbine according to a third embodiment of the present invention will be described. In comparison with the steam turbine 1 of the first embodiment, in the steam turbine according to the embodiment, in the cavity C formed at surroundings of a tip section of the turbine blade 51, a position at which the dead water region-filling section is installed is different. Since the other configurations are the same as those of the first embodiment, the same reference numerals are used and description thereof will be omitted.

Figure 5:
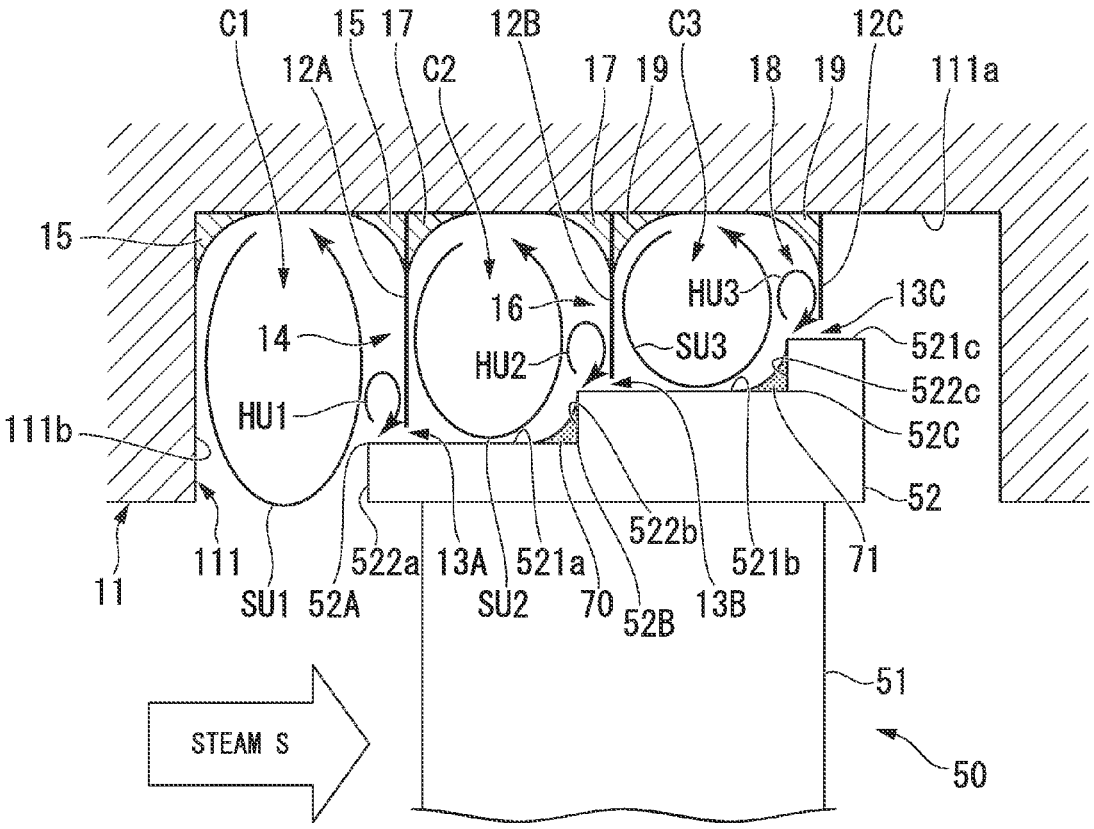
FIG. 5 is a schematic cross-sectional view showing surroundings of a tip section of a turbine blade of a third embodiment.

FIG. 5 is a schematic cross-sectional view showing surroundings of a tip section of the turbine blade 51 of the third embodiment. Similar to the first embodiment, the three cavities C are formed between the annular turbine blade group 50 and the diaphragm outer ring 11. Then, among the three cavities C, the dead water region-filling sections 15 are formed at the same two corners as in the first embodiment shown in FIG. 2, respectively, in the first cavity C1 disposed at the furthest upstream side in the axial direction. In addition, in FIG. 5, the same configurations as those of the first embodiment are designated by the same reference numerals of FIG. 2.

Further, as shown in FIG. 5, among the three cavities C, in the second cavity C2 disposed at a second upstream side in the axial direction, the dead water region-filling sections 17 are formed at the same two corners as in the first embodiment shown in FIG. 2, respectively, and the dead water region-filling section 70 is also formed at the same one corner as in the second embodiment shown in FIG. 4.

In addition, as shown in FIG. 5, among the three cavities, in the third cavity C3 disposed at the furthest downstream side in the axial direction, the dead water region-filling sections 19 are formed at the same two corners as in the first embodiment shown in FIG. 2, respectively, and the dead water region-filling section 71 is also formed at the same one corner as in the second embodiment of FIG. 4.

Next, effects of the steam turbine 1 according to the third embodiment will be described focusing on differences from the first embodiment. According to the configuration shown in FIG. 5, since the dead water region-filling section 70 is further formed in the second cavity C2 in addition to the two dead water region-filling sections 17, in comparison with the first embodiment, energy loss of the steam S in the dead water region can be further prevented. Accordingly, the separation vortex HU2 can also be further strengthened because the main vortex SU2 can be further strengthened, and the leakage amount of the steam S in the small clearance 13B can be further reduced compared with the first embodiment. In addition, in the third cavity C3, for the same reason as in the second cavity C2, the leakage amount of the steam S in the small clearance 13C can be even further reduced compared with the first embodiment.

Further, in the embodiment, as the dead water region-filling sections 70 and 71 are formed at the acute angled sections 52B and 52C of the tip shroud 52, respectively, similar to the second embodiment, generation of stress concentration at the section due to thermal expansion or expansion due to a centrifugal force can be attenuated.

Fourth Embodiment

Next, a configuration of the steam turbine according to a fourth embodiment of the present invention will be described. In comparison with the steam turbine 1 of the first embodiment, the steam turbine according to the embodiment has a different installation position and shape of the dead water region-filling section from the steam turbine 1 in the cavity C formed at surroundings of a tip section of the moving blade 51. Since the other configurations are the same as those of the first embodiment, the same reference numerals are used and description thereof will be omitted.

Figure 6:
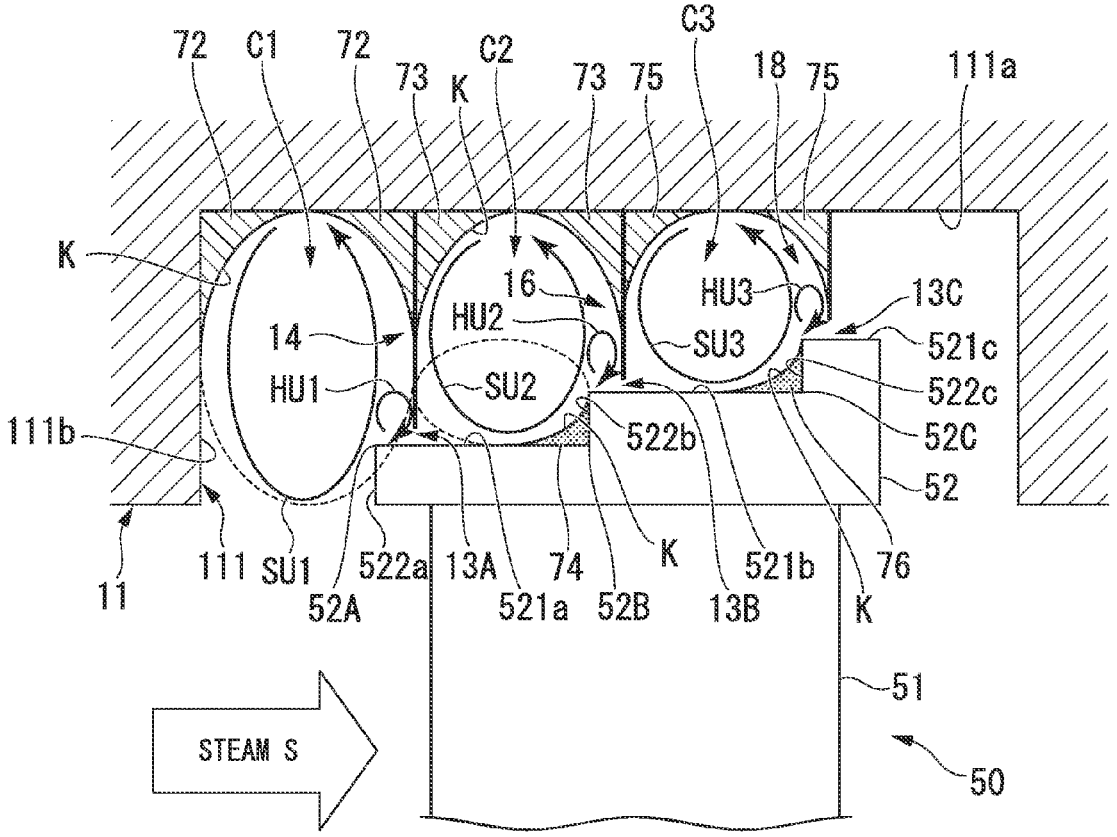
FIG. 6 is a schematic cross-sectional view showing surroundings of a tip section of a turbine blade of a fourth embodiment.

FIG. 6 is a schematic cross-sectional view showing surroundings of a tip section of the turbine blade 51 of the fourth embodiment. Similar to the first embodiment, the three cavities C are formed between the annular turbine blade group 50 and the diaphragm outer ring 11. Then, while the dead water region-filling sections are formed at the same corners as in the third embodiment shown in FIG. 5 in the three cavities C, shapes of the inclined surfaces K included in the dead water region-filling sections are different from those of the third embodiment. In addition, in FIG. 6, the same configurations as those of the first embodiment are designated by the same reference numerals as in FIG. 2.

More specifically, as shown in FIG. 6, among the three cavities C, in the first cavity C1 disposed at the furthest upstream side in the axial direction, dead water region-filling sections 72 having substantially oval arc-shaped inclined surfaces K are formed at the same two corners as in the first embodiment shown in FIG. 2.

In addition, in the second cavity C2 disposed at a second upstream side in the axial direction, dead water region-filling sections 73 having substantially oval arc-shaped inclined surfaces K are formed at the same two corners as in the first embodiment, and a dead water region-filling section 74 having a substantially oval arc-shaped inclined surface K is formed at the same one corner as in the second embodiment.

Further, in the third cavity C3 disposed at the furthest downstream side in the axial direction, dead water region-filling sections 75 having substantially oval arc-shaped inclined surfaces K are formed at the same two corners as in the first embodiment, and a dead water region-filling section 76 having a substantially oval arc-shaped inclined surface K is formed at the same one corner as in the second embodiment.

Next, effects of the steam turbine 1 according to the fourth embodiment will be described focusing on differences from the third embodiment. According to the configuration shown in FIG. 6, since all of the dead water region-filling sections 72 to 76 formed in the three cavities C have substantially oval arc-shaped inclined surfaces K, in addition to the effect performed by the steam turbine 1 of the third embodiment, according to the shape of the three cavities C, the leakage amount of the steam S in the small clearances 13A, 13B and 13C can be further reduced more than in the third embodiment.

This is because, since a cross-sectional shape in the axial direction of the main vortexes SU1, SU2 and SU3 generated in the three cavities C generally has an oval shape rather than a perfect circle, shapes of the inclined surfaces K of the dead water region-filling sections 72 to 76 also have substantially oval arc shapes to more accurately conform to the shapes of the main vortexes SU1, SU2 and SU3 so that the energy loss of the steam S due to a flow in the dead water region can be more securely prevented than in the third embodiment.

In addition, as shown in FIG. 6, in the embodiment, while the inclined surface K of the dead water region-filling sections 72, 73 and 75 formed at the diaphragm outer ring 11 side has a substantially oval arc shape elongated in the radial direction, the inclined surface K of the dead water region-filling sections 74 and 76 formed at the tip shroud 52 side has a substantially oval arc shape elongated in the axial direction. According to the above-mentioned configuration, since the main vortexes SU1, SU2 and SU3 can be accurately guided to collide with the angled section of the tip shroud 52, separation directions of the separation vortexes HU1, HU2 and HU3 can coincide in the radial direction. Accordingly, since the separation vortexes HU1, HU2 and HU3 just before the small clearances 13A, 13B and 13C have inertial forces in the radial direction, the contraction flow effect of the separation vortexes HU1, HU2 and HU3 can be increased. In addition, design of the formation of the inclined surface K of the dead water region-filling sections 72 to 76 having the substantially oval arc shapes in any one of the axial direction and the radial direction can be appropriately changed.

Fifth Embodiment

Next, a configuration of a steam turbine according to a fifth embodiment of the present invention will be described. In comparison with the steam turbine 1 of the first embodiment, the steam turbine according to the embodiment has different positions and shapes of dead water region-filling sections in the cavity C formed at surroundings of a tip section of the moving blade 51. Since the other configurations are the same as those of the first embodiment, the same reference numerals are used and description thereof will be omitted.

Figure 7:
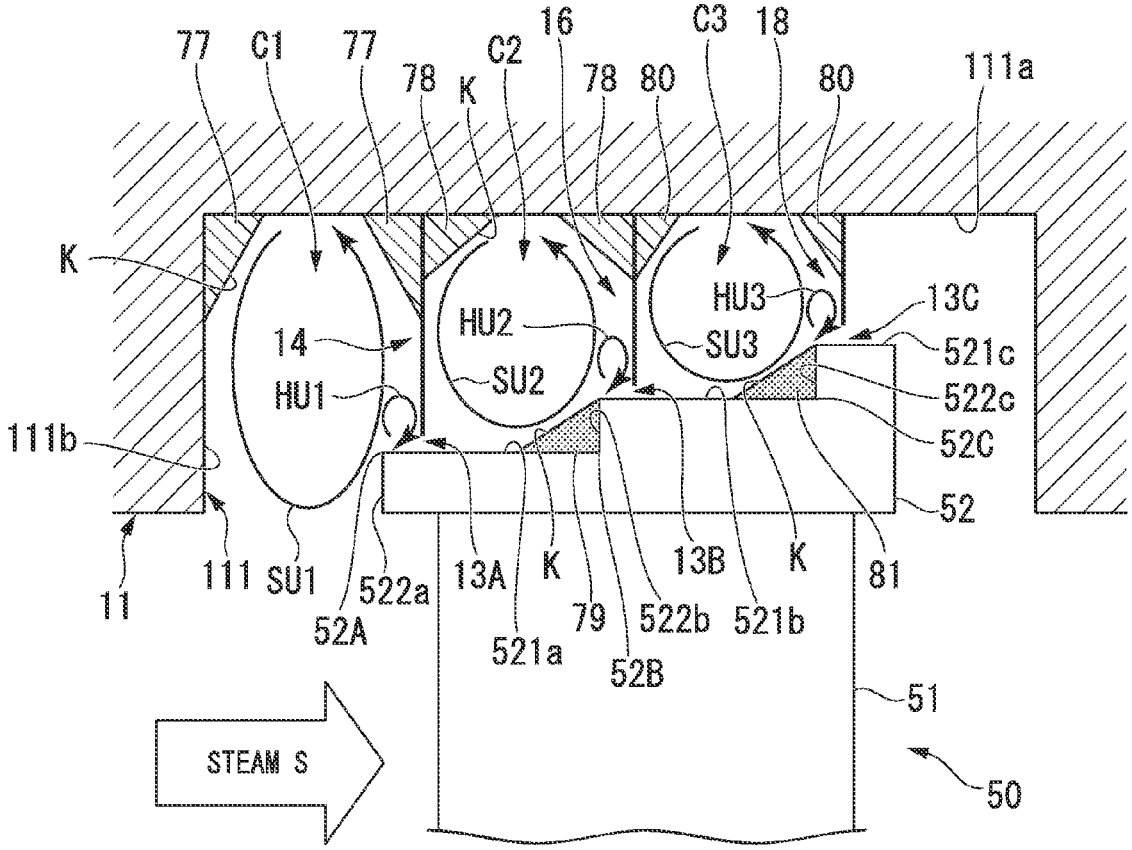
FIG. 7 is a schematic cross-sectional view showing surroundings of a tip section of a turbine blade of a fifth embodiment.

FIG. 7 is a schematic cross-sectional view showing surroundings of a tip section of the turbine blade 51 of the fifth embodiment. Similar to the first embodiment, the three cavities C are formed between the annular turbine blade group 50 and the diaphragm outer ring 11. Then, in the three cavities C, while dead water region-filling sections are formed at the same corners as in the third embodiment shown in FIG. 5, a shape of the inclined surface K included in each of the dead water region-filling section is different from that of the third embodiment. In addition, in FIG. 7, the same configurations as those of the first embodiment are designated by the same reference numerals as in FIG. 2.

More specifically, as shown in FIG. 7, among the three cavities C, in the first cavity C1 disposed at the furthest upstream side in the axial direction, dead water region-filling sections 77 having substantially linear shaped inclined surfaces K are formed at the same two corners as in the first embodiment shown in FIG. 2.

In addition, in the second cavity C2 disposed at a second upstream side in the axial direction, dead water region-filling sections 78 having substantially linear shaped inclined surfaces K are formed at the same two corners as in the first embodiment, and a dead water region-filling section 79 having a substantially linear shaped inclined surface K is formed at the same one corner as in the second embodiment.

Further, in the third cavity C3 disposed at the furthest downstream side in the axial direction, dead water region-filling sections 80 having substantially linear shaped inclined surfaces K are formed at the same two corners as in the first embodiment, and a dead water region-filling section 81 having a substantially linear shaped inclined surface K is formed at the same one corner as in the second embodiment.

Next, effects of the steam turbine 1 according to the fifth embodiment will be described focusing on differences from the third embodiment. According to the configuration shown in FIG. 7, since all of the dead water region-filling sections 77 to 81 installed at the three cavities C have the substantially linear shaped inclined surfaces K, in addition to an effect performed by the steam turbine 1 of the third embodiment, manufacture of the dead water region-filling sections 77 to 81 can be simplified more than in the third embodiment. Specifically, when the dead water region-filling sections 77 to 81 are constituted by separate members from the diaphragm outer ring 11 or the tip shroud 52, a processing operation of the dead water region-filling sections 77 to 81 can be easily performed. Meanwhile, when the dead water region-filling sections 77 to 81 are integrally configured with the diaphragm outer ring 11 or the tip shroud 52, a shape of a mold for forming the diaphragm outer ring 11 or the tip shroud 52 can be simplified.

In addition, in the embodiment, while the case in which the dead water region-filling sections 77 to 81 have one inclined surface K having a substantially linear shape has been described, the dead water region-filling sections 77 to 81 may have a plurality of inclined surfaces K having substantially linear shapes. That is, the cross-sectional shape of the dead water region-filling sections 77 to 81 is not limited to a triangular shape of the embodiment but may be a polygonal shape.

Sixth Embodiment

Next, a configuration of a steam turbine according to a sixth embodiment of the present invention will be described. In comparison with the steam turbine 1 of the first embodiment, the steam turbine according to the embodiment, an installation position of the dead water region-filling section is at surroundings of a tip section of the turbine vane 41 rather than surroundings of a tip section of the turbine blade 51. Since the other components are the same as those of the first embodiment, the same reference numerals are used and description thereof will be omitted. In addition, in the embodiment, the annular turbine vane group 40 corresponds to the blade according to the present invention, and the shaft body 30 corresponds to the structure according to the present invention.

Figure 8:
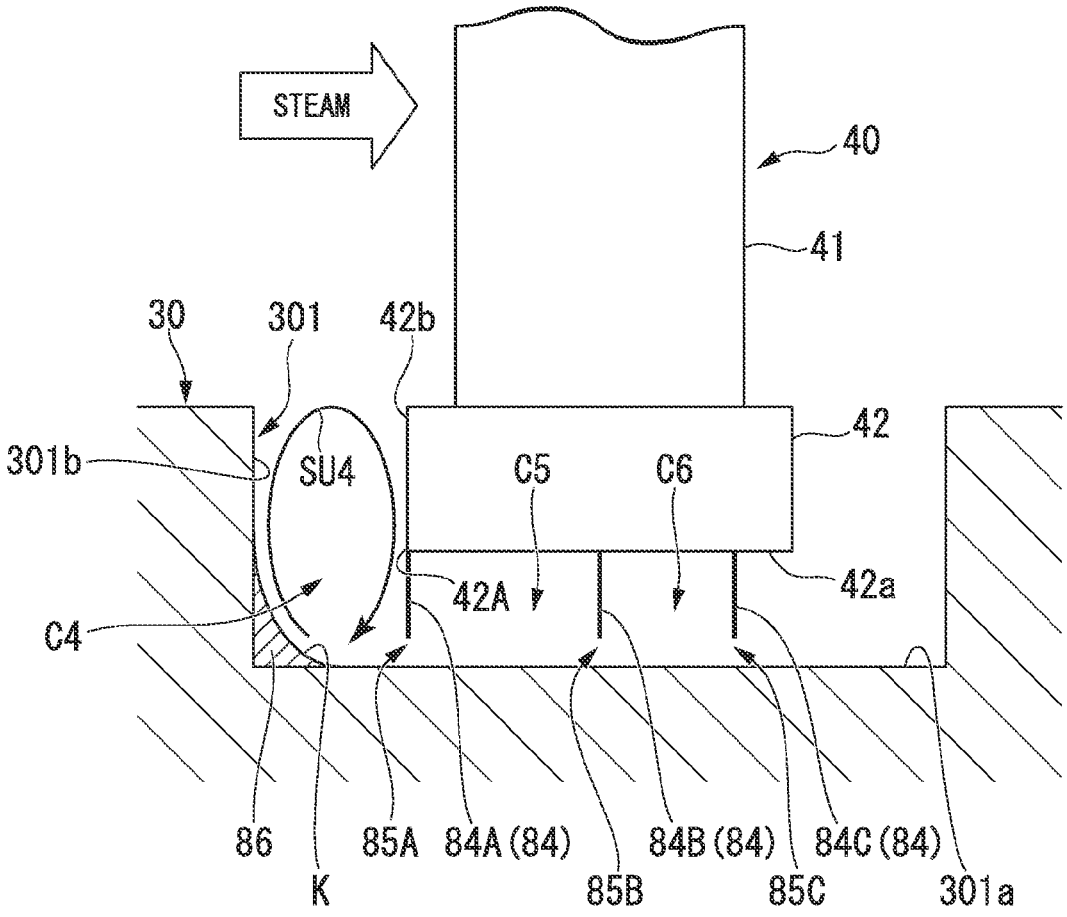
FIG. 8 is a partially enlarged cross-sectional view showing surroundings of a tip section of a turbine vane of a sixth embodiment.

FIG. 8 is a partially enlarged cross-sectional view showing surroundings of a tip section of the turbine vane 41 of the sixth embodiment. The above-mentioned ring-shaped hub shroud 42 is disposed at a tip section of the turbine vane 41. Then, three seal fins 84 are installed to protrude from an outer circumferential surface 42*a* of the hub shroud 42 in the radial direction. Then, among the three seal fins 84, a first seal fin 84A formed at the furthest upstream side in the axial direction is configured to form substantially the same surface as an axial direction end surface 42*b* of the hub shroud 42 disposed at a furthest upstream section in the axial direction.

Meanwhile, an annular groove 301 having a concave cross-sectional shape is formed at the outer circumferential surface of the shaft body 30, and a portion reduced in diameter by forming the annular groove 301 is inserted into the hub shroud 42. Accordingly, small clearances 85 are formed between a bottom surface 301*a* of the annular groove 301 and the seal fins 84 in the radial direction, respectively.

In addition, a length, a shape, an installation position, the number, or the like, of the seal fins 84 is not limited to the embodiment but design thereof may be appropriately changed according to a cross-sectional shape or the like of the hub shroud 42 and/or the shaft body 30. Further, a dimension of the small clearance 85 may be appropriately set to a minimum value within a safe range in which the seal fin 84 is not in contact with the shaft body 30. Furthermore, in the embodiment, while the seal fin 84 is formed to protrude from the hub shroud 42 and the small clearance 85 is formed between the seal fin 84 and the shaft body 30, the seal fin 84 may also be formed to protrude from the shaft body 30 and the small clearance 85 may be formed between the seal fin 84 and the hub shroud 42.

Then, according to the configuration of the surroundings of the tip section of the above-mentioned turbine vane 41, as shown in FIG. 8, the three cavities C are formed by the shaft body 30, the seal fin 84 and the hub shroud 42. Here, among the three cavities C, as shown in FIG. 8, a fourth cavity C4 disposed at the furthest upstream side in the axial direction is formed by the bottom surface 301*a* and a side surface 301*b* of the annular groove 301, the first seal fin 84A, and the axial direction end surface 42*b* of the hub shroud 42. The fourth cavity C4 formed as described above has a substantially rectangular cross-sectional shape in the axial direction.

Then, as shown in FIG. 8, a dead water region-filling section 86 is formed at one corner of the fourth cavity C4, more specifically, a corner formed by the bottom surface 301*a* and the side surface 301*b* of the annular groove 301. The one dead water region-filling section 86 has a substantially oval arc-shaped inclined surface K in a cross-section in the axial direction.

In addition, the dead water region-filling section 86 has the same function as that of the first embodiment. Further, a shape of the inclined surface K of the dead water region-filling section 86 may be a substantial arc shape or a substantially linear shape as well as the substantially oval arc shape of the embodiment. Furthermore, in the embodiment, while the dead water region-filling section 86 is formed in only the fourth cavity among the three cavities C, a dead water region-filling section may also be formed in a fifth cavity C5 disposed at a second upstream side or a sixth cavity C6 disposed at the furthest downstream side. That is, the dead water region-filling section may be formed at a corner formed by the outer circumferential surface 42*a* of the hub shroud 42 and a second seal fin 84B or a corner formed by the outer circumferential surface 42*a* of the hub shroud 42 and a third seal fin 84C.

Next, effects of the steam turbine 1 according to the sixth embodiment will be described. While the steam S flowing into the casing 10 shown in FIG. 1 normally passes between the plurality of turbine vanes 41 constituting the annular turbine vane group 40 to be guided to the annular turbine blade group 50, some of the steam S passes through the small clearance 85 (85A, 85B and 85C) between the annular turbine vane group 40 and the shaft body 30 to be leaked to the downstream side.

The leakage of the steam S will be more specifically described. As shown in FIG. 8, the steam S flowing in the axial direction flows into the fourth cavity C4, while some of the steam S is not guided to the downstream side by the turbine vane 41. The steam S flowing into the fourth cavity C4 collides with the axial direction end surface 42*b* of the hub shroud 42 to form, for example, a main vortex SU4 in a clockwise direction of FIG. 8. Here, since the first seal fin 84A is formed to have substantially the same surface as the axial direction end surface 42*b* of the hub shroud 42, the main vortex SU4 does not generate a separation vortex at an angled section 42A of the hub shroud 42. However, in the embodiment, since the main vortex SU4 is rotated clockwise, the main vortex SU4 has an inertial force outward in the radial direction just before the small clearance 85A. Accordingly, the main vortex SU4 shows the contraction flow effect of reducing the leakage amount thereof by pushing and reducing the steam S passing through the small clearance 85A to be leaked to the downstream side.

Further, as shown in FIG. 8, the dead water region-filling section 86 having a substantially oval arc shape is formed at one corner of the fourth cavity C4 along a flow of the main vortex SU4. Accordingly, the dead water region generated in the fourth cavity C4 can be reduced, and energy loss of the steam S due to a flow in the dead water region can be reduced. Therefore, since the main vortex SU4 can be strengthened in comparison with the case in which dead water region-filling section 86 is not provided, as a result, the contraction flow effect of the main vortex SU4 can be increased, and the leakage amount of the steam S in the small clearance 85A can be reduced.

Seventh Embodiment

Next, a configuration of a steam turbine according to a seventh embodiment of the present invention will be described. The steam turbine according to the embodiment is distinguished from the steam turbine of the sixth embodiment in that a shape of a cavity formed at the furthest upstream side in the axial direction is different therefrom. Since the other configurations are the same as those of the sixth embodiment, the same reference numerals are used and description thereof will be omitted.

Figure 9:
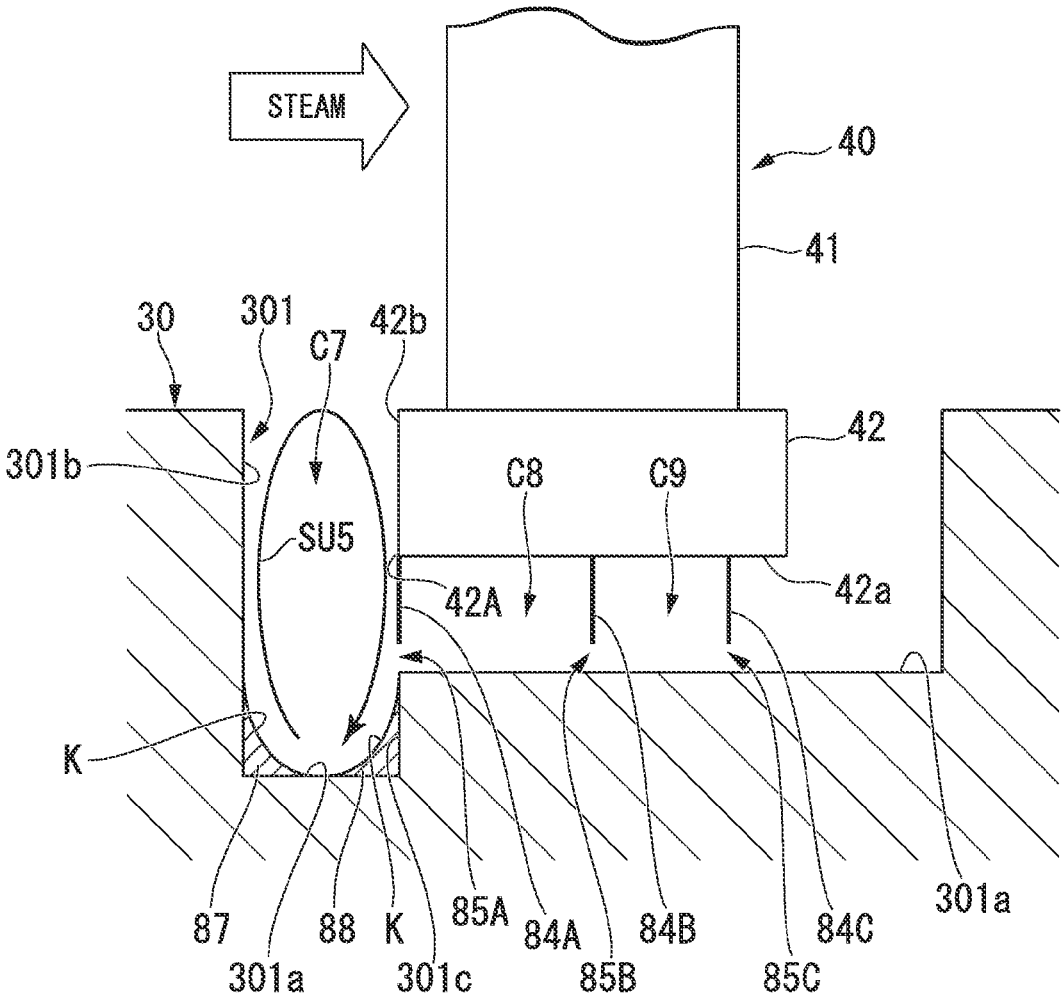
FIG. 9 is a partially enlarged cross-sectional view of surroundings of a tip section of a turbine vane of a seventh embodiment.

FIG. 9 is a partially enlarged cross-sectional view showing surroundings of a tip section of the turbine vane 41 of the seventh embodiment. Similar to the sixth embodiment, the three cavities C are formed between the annular turbine vane group 40 and the shaft body 30. However, among the three cavities C, a seventh cavity C7 disposed at the furthest upstream side in the axial direction, i.e., a portion of an upstream side rather than a downstream side of the first seal fin 84A is formed to be stepped downward in the radial direction, formed to be disposed inside in the radial direction in the embodiment. In addition, in the sixth embodiment, while the seal fin 84 can be formed to protrude from the shaft body 30 rather than the hub shroud 42 side, in the embodiment, the seal fin 84 should be formed at the hub shroud 42 side and cannot be formed at the shaft body 30. Further, the seal fin 84 is formed to protrude from the tip shroud 52 constituting the turbine blade 51 without being limited to the surroundings of the tip section of the turbine vane 41, and the portion of the upstream side rather than the area of the downstream side of the seal fin 84 may be formed to be stepped downward in the radial direction, i.e., disposed outside in the radial direction.

Then, as shown in FIG. 9, dead water region-filling sections 87 and 88 are formed at two corners of the seventh cavity C7. More specifically, the dead water region-filling section 87 is formed at the corner formed by the bottom surface 301*a* and the side surface 301*b* of the annular groove 301, and the dead water region-filling section 88 is formed at the corner formed by the bottom surface 301*a* and a stepped surface 301*c*. The two dead water region-filling sections 87 and 88 have the inclined surfaces K having substantially oval arc shapes in a cross-section in the axial direction, respectively.

Next, effects of the steam turbine 1 according to the seventh embodiment will be described focusing on differences from the sixth embodiment. In the embodiment, as shown in FIG. 9, as the first seal fin 84A is formed to protrude from the hub shroud 42, a position at which the small clearance 85A is formed becomes a position near the shaft body 30. Then, the seventh cavity C7 of the upstream side of the small clearance 85A is formed to be stepped downward from an eighth cavity C8 and a ninth cavity C9 of the downstream side.

According to the above-mentioned configuration, as shown in FIG. 9, a main vortex SU5 rotated clockwise in the seventh cavity C7 passes through the small clearance 85A to reach a further downward side (inward in the radial direction).

Accordingly, in the main vortex SU5 of the embodiment, in comparison with the case in which there is no step-down such as the sixth embodiment shown in FIG. 8, a pivot center of the main vortex SU5 approaches the small clearance 85A. Therefore, since a velocity in the radial direction of the main vortex SU5 in the vicinity of the small clearance 85A is higher when there is a step-down than when there is no step-down, and the contraction flow effect of the main vortex SU5 is increased, the leakage amount of the steam S in the small clearance 85A can be further reduced.

In addition, in the embodiment, since the dead water region-filling sections 87 and 88 are formed at two corners of the seventh cavity C7, in comparison with the case in which the dead water region-filling section 86 is formed at only one corner of the fourth cavity C4 of the sixth embodiment, the dead water region can be further reduced to further strengthen the main vortex SU5.

Accordingly, in the embodiment, in comparison with the sixth embodiment, the leakage amount of the steam S in the small clearance 85A can be further reduced.

Eighth Embodiment

Next, a configuration of a steam turbine according to an eighth embodiment of the present invention will be described. The steam turbine according to the embodiment is distinguished from the steam turbine of the sixth embodiment in that shapes of the cavities are different. Since the other configurations are the same as those of the sixth embodiment, the same reference numerals are used and description thereof will be omitted.

Figure 10:
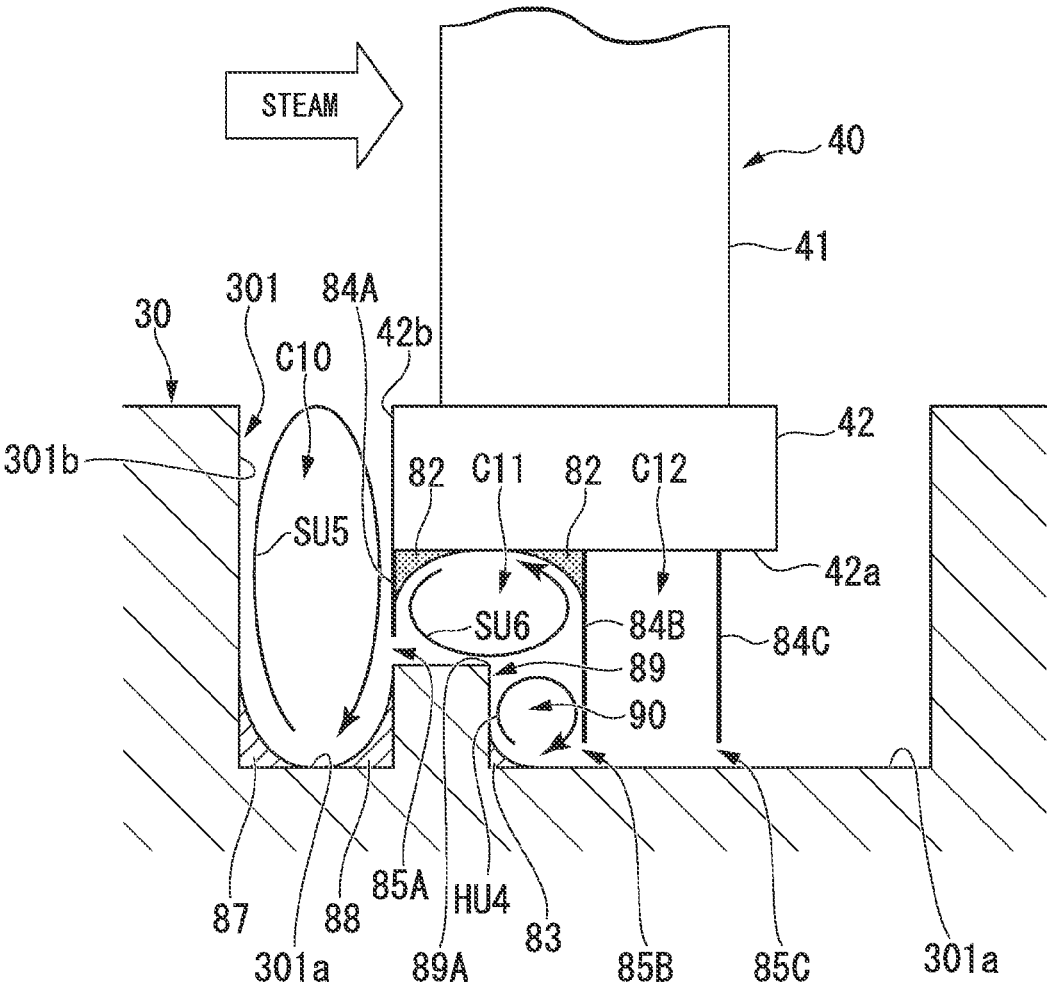
FIG. 10 is a partially enlarged cross-sectional view of surroundings of a tip section of a turbine vane of an eighth embodiment.

FIG. 10 is a partially enlarged cross-sectional view showing surroundings of a tip section of the turbine vane 41 of the eighth embodiment. Similar to the seventh embodiment, the three cavities C are formed between the annular turbine vane group 40 and the shaft body 30. However, among the three cavities C, while a tenth cavity C10 disposed at the furthest upstream side has the same configuration as the seventh cavity C7 of the seventh embodiment, configurations of an eleventh cavity C11 and a twelfth cavity C12 disposed at a downstream side thereof are different from the eighth cavity C8 and the ninth cavity C9 of the seventh embodiment.

More specifically, as shown in FIG. 10, on the bottom surface 301*a* of the annular groove 301, a stepped section 89 is formed to step down inward in the radial direction at the downstream side rather than the upstream side in the axial direction at a position between the adjacent first seal fin 84A and second seal fin 84B.

Accordingly, a widened section 90 slightly widened in the radial direction is formed at a downstream section in an axial direction of the eleventh cavity C11. Then, at the downstream side of the stepped section 89, a radial direction height position of the bottom surface 301*a* becomes substantially the same height position as the bottom surface 301*a* forming the tenth cavity C10. In addition, the bottom surface 301*a* at the downstream side of the stepped section 89 may be disposed at a different height position from the bottom surface 301*a* forming the tenth cavity C10.

Then, as shown in FIG. 10, similar to the seventh embodiment, the dead water region-filling sections 87 and 88 are formed at the two corners of the tenth cavity C10. In addition, dead water region-filling sections 82 and a dead water region-filling section 83 are formed at three corners of the eleventh cavity C11, respectively. More specifically, the dead water region-filling sections 82 are formed at a corner formed by the outer circumferential surface 42*a* of the hub shroud 42 and the first seal fin 84A and a corner formed by the outer circumferential surface 42*a* and the second seal fin 84B. In addition, the dead water region-filling section 83 is formed at a corner formed by the stepped section 89 and the bottom surface 301*a*.

Next, effects of the steam turbine 1 according to the eighth embodiment will be described focusing on differences from the seventh embodiment. According to the configuration shown in FIG. 10, in the tenth cavity C10, similar to the seventh cavity C7 of the seventh embodiment, the main vortex SU5 in a clockwise direction is formed, and the same effect as in the seventh embodiment is performed.

In addition, according to the configuration shown in FIG. 10, the steam S flowing into the eleventh cavity C11 from the tenth cavity C10 via the small clearance 85A forms a main vortex SU6 in a counterclockwise direction in the eleventh cavity C11. Then, as some of the main vortex SU6 is separated therefrom at the angled section of the stepped section 89, a separation vortex HU4 in a clockwise direction is generated. Here, since the separation vortex HU4 has an inertial force inward in the radial direction just before the small clearance 85B between the second seal fin 84B and the shaft body 30, a large contraction flow effect is obtained. Accordingly, in comparison with the case in which the stepped section 89 is not formed in the eleventh cavity C11 and only the main vortex SU6 in a counterclockwise direction is generated in the eleventh cavity C11, the embodiment shows an effect of further reducing the leakage amount of the steam S in the small clearance 85B formed by the tip section of the second seal fin 84B.

Further, as shown in FIG. 10, the dead water region-filling sections 82 are formed at two corners of the eleventh cavity C11 along a flow of the main vortex SU6, and the dead water region-filling section 83 is formed at one corner along a flow of the separation vortex HU4. Accordingly, in both of the main vortex SU6 and the separation vortex HU4, energy loss due to introduction into the dead water region can be reduced. Accordingly, in comparison with the case in which the dead water region-filling sections 82 and 83 are not provided, since both of the main vortex SU6 and the separation vortex HU4 can be strengthened, the leakage amount of the steam S in the small clearance 85B can be reduced.

Figure 11:
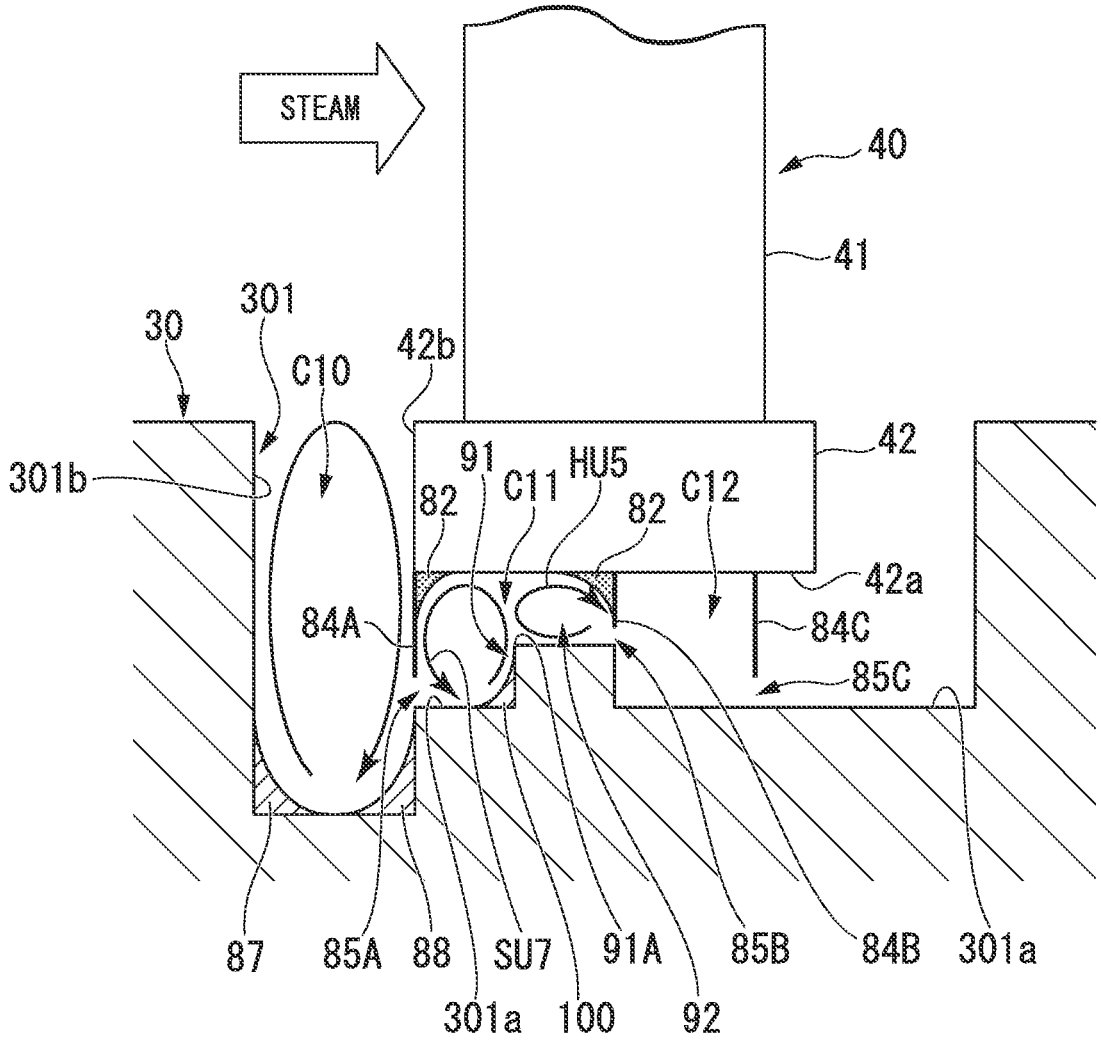
FIG. 11 is a partially enlarged cross-sectional view showing a variant of the eighth embodiment.

In addition, in the embodiment, while the stepped section 89 is formed to step down inward in the radial direction at the downstream side rather than the upstream side in the axial direction, as shown in FIG. 11, a stepped section 91 may be formed to step up outward in the radial direction at the downstream side rather than the upstream side. In this case, a widened section 92 slightly widened in the axial direction is formed at a downstream section in an axial direction of the eleventh cavity C11.

Then, similar to the configuration shown in FIG. 10, the dead water region-filling sections 82 are formed at a corner formed by the outer circumferential surface 42*a* of the hub shroud 42 and the first seal fin 84A and a corner formed by the outer circumferential surface 42*a* and the second seal fin 84B. Further, a dead water region-filling section 100 is formed at a corner formed by the stepped section 91 and the bottom surface 301*a*.

According to the above-mentioned configuration, the steam S flowing into the eleventh cavity C11 from the tenth cavity C10 through the small clearance 85A also forms a main vortex SU7 in the eleventh cavity C11. Then, as some of the main vortex SU7 is separated therefrom at the angled section of the stepped section 91, a separation vortex HU5 in a clockwise direction is generated. Accordingly, even when the stepped section 91 is formed, the same effect as in the case in which the stepped section 89 is formed can be obtained.

In addition, as shown in FIG. 11, since the dead water region-filling sections 82 are formed at the two corners of the eleventh cavity C11, energy loss of the main vortex SU7 can be reduced similar to the configuration of FIG. 10, and since the dead water region-filling section 100 is formed at one corner, energy loss of the separation vortex HU5 can also be reduced. Thus, according to the configuration shown in FIG. 11, in comparison with the case in which the dead water region-filling sections 82 and 100 are not provided, the leakage amount of the steam S in the small clearance 85B can be reduced.

Ninth Embodiment

Figure 12:
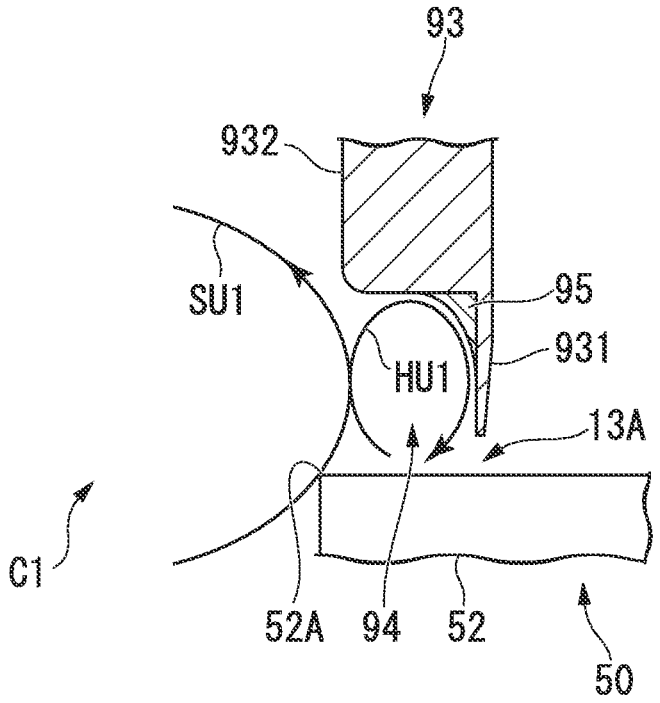
FIG. 12 is a schematic cross-sectional view showing surroundings of a tip section of a turbine blade of a ninth embodiment, particularly, enlarging a tip section of a first seal fin.

Next, a configuration of a steam turbine according to a ninth embodiment of the present invention will be described. The steam turbine according to the embodiment is distinguished from the steam turbine 1 of the first embodiment in that an installation position of a dead water region-filling section in the cavity C formed at surroundings of a tip section of the moving blade 51 is different. Here, FIG. 12 is a schematic cross-sectional view showing surroundings of a tip section of the turbine blade 51 of the ninth embodiment, in particular, enlarging a tip section of a first seal fin 93. In addition, since the configurations other than the first seal fin 93 are the same as those of the first embodiment, the same reference numerals are used and description thereof will be omitted.

In the embodiment, the first seal fin 93 has a fin body section 931 and a space limiting section 932 formed to be wider than the fin body section 931. Accordingly, the first cavity C1 at an upstream side of the first seal fin 93 has a widened section 94 slightly widened in axial direction at a downstream section in an axial direction thereof. Then, a dead water region-filling section 95 is formed at a corner of the widened section 94, and more specifically, a corner formed by the fin body section 931 and the space limiting section 932.

Next, effects of the steam turbine 1 according to the ninth embodiment will be described focusing on differences from the first embodiment. According to the configuration shown in FIG. 12, as the main vortex SU1 in a counterclockwise direction formed in the first cavity C1 is partially separated at an angled section of the tip shroud 52, the separation vortex HU1 in a clockwise direction is generated in the widened section 94. Here, as the separation vortex HU1 collides with the space limiting section 932 and the fin body section 931 and a flow direction thereof is guided, a vortex flow is strengthened. Further, since the dead water region-filling section 95 is formed at a corner of the widened section 94, energy loss of the steam S due to introduction of the separation vortex HU1 into the dead water region can be reduced. Accordingly, in comparison with the case in which the dead water region-filling section 95 is not provided, since the contraction flow effect can be increased by strengthening the separation vortex HU1, the leakage amount of the steam S in the small clearance 13A can be reduced.

Tenth Embodiment

Next, a configuration of a steam turbine according to a tenth embodiment of the present invention will be described. The steam turbine of the embodiment is distinguished from the steam turbine 1 of the first embodiment in that an installation position of the dead water region-filling section in the cavity C formed at surroundings of a tip section of the turbine blade 51 is different.

Since the other configurations are the same as those of the first embodiment, the same reference numerals are used and description thereof will be omitted.

Figure 13:
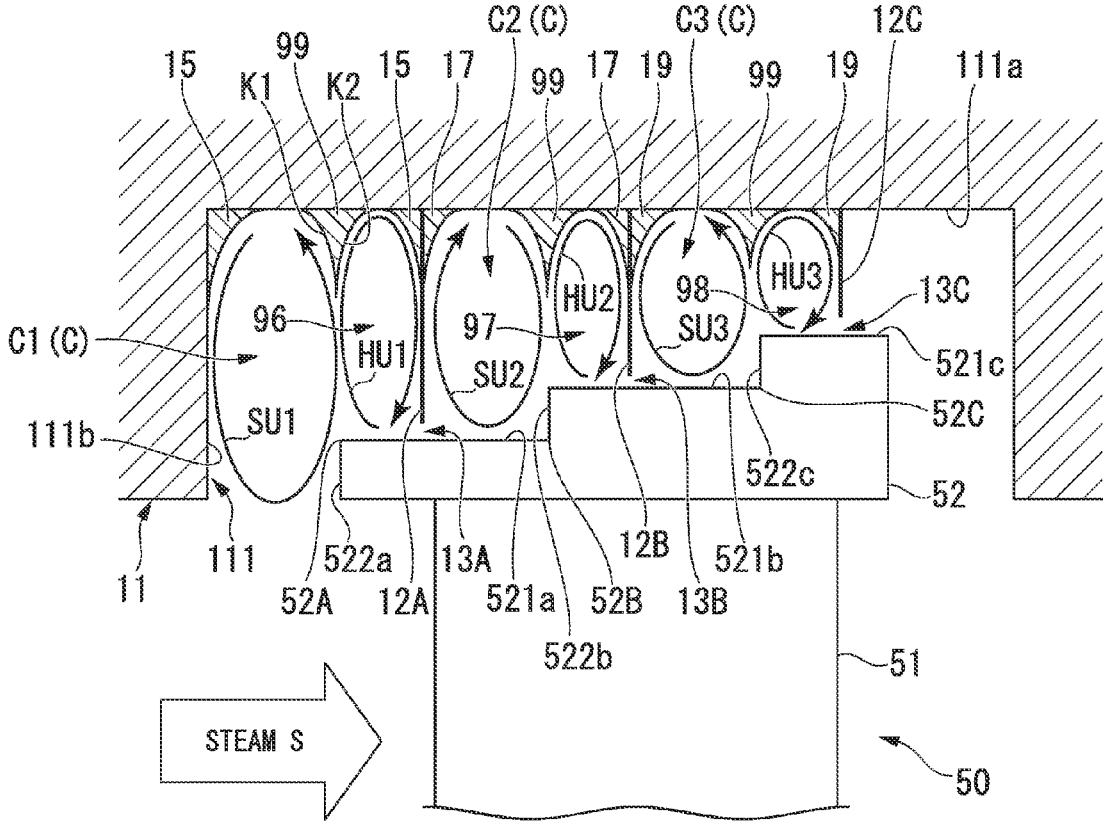
FIG. 13 is a schematic cross-sectional view showing surroundings of a tip section of a turbine blade of a tenth embodiment.

FIG. 13 is a schematic cross-sectional view showing surroundings of a tip section of the turbine blade 51 of the tenth embodiment. Similar to the first embodiment, the three cavities C are formed between the annular turbine blade group 50 and the diaphragm outer ring 11. Here, in the embodiment, clearances in the axial direction from the seal fins 12A, 12B and 12C to the radial direction wall surfaces 522*a*, 522*b* and 522*c* are set to be larger than those of the first embodiment. Accordingly, the three cavities C1, C2 and C3 have widened sections 96, 97 and 98 formed to be wider than those of the first embodiment.

Then, among the three cavities C, the dead water region-filling sections 15 are formed at two corners of the first cavity C1 disposed at the furthest upstream side in the axial direction, similar to the first embodiment. More specifically, the dead water region-filling sections 15 are formed at a corner formed by the bottom surface 111*a* and the side surface 111*b* of the annular groove 111 and a corner formed by the bottom surface 111*a* of the annular groove 111 and the first seal fin 12A.

Further, in the embodiment, in the first cavity C1, in addition to the two corners, a dead water region-filling section 99 is formed at an intermediate position of the two corners on the bottom surface 111*a* of the annular groove 111. The dead water region-filling section 99 has two inclined surfaces K1 and K2 such that one inclined surface K1 is formed along a flow of the main vortex SU1 generated in the first cavity C1 and the other inclined surface K2 is similarly formed along a flow of the separation vortex HU1 generated in the widened section 96 of the first cavity C1. In addition, similar to the first cavity C1, the dead water region-filling sections 17 and 19 are also formed at two corners of the second cavity C2 and the third cavity C3, respectively, and the dead water region-filling section 99 is formed at an intermediate position of the two corners of the bottom surface 111*a*.

Next, effects of the steam turbine 1 according to the tenth embodiment will be described focusing on differences from the first embodiment. According to the configuration shown in FIG. 13, since the above-mentioned widened sections 96, 97 and 98 are formed to be wider than those of the first embodiment, the separation vortexes HU1, HU2 and HU3 have sufficient sizes to reach the bottom surface 111*a* of the annular groove 111.

Here, in the first cavity C1 of the embodiment, since a total of three dead water region-filling sections 15, 15 and 99 are formed, energy loss of the steam S due to introduction of both the main vortex SU1 and the separation vortex HU1 into the dead water region can be reduced. Accordingly, the separation vortex HU1 can be indirectly strengthened by strengthening the main vortex SU1, and the separation vortex HU1 can also be directly strengthened. As a result, since the contraction flow effect of the separation vortex HU1 can be strengthened in comparison with the case in which the dead water region-filling sections 15, 15 and 99 are not provided, the leakage amount of the steam S in the small clearance 13A can be reduced.

Similarly, since a total of three dead water region-filling sections 17, 17 and 99 and 19, 19 and 99 are formed even in each of the second cavity C2 and the third cavity C3 of the embodiment, and the same effect as that of the first cavity C1 can be obtained, the leakage amount of the steam S in the small clearances 13B and 13C can be reduced.

In addition, all shapes, assemblies or operation sequences of the respective components shown in the above-mentioned embodiments are exemplarily provided, and may be variously modified based on design requirements within a range without departing from the teachings of the present invention.

INDUSTRIAL APPLICABILITY

The present invention relates to a turbine including a blade disposed at a flow path through which a fluid flows, a structure installed at a tip side of the blade via a clearance and relatively rotated with respect to the blade, and a seal fin formed to protrude from any one of the blade and the structure and configured to form a small clearance with the other, wherein a dead water region-filling section is formed in a space formed by the blade, the structure and the seal fin and in which a vortex flow of the fluid is generated, such that a dead water region that the vortex flow cannot reach is filled.

According to the present invention, the vortex flow can be strengthened in comparison with the case in which the dead water region-filling section is not provided, and a contraction flow effect can be increased when the vortex flow has the contraction flow effect, and a leakage amount of the fluid in the clearance between the blade tip section and the structure can be reduced.

DESCRIPTION OF REFERENCE NUMERALS

1: steam turbine
10: casing
11: diaphragm outer ring (structure)
111: annular groove
111*a*: bottom surface
111*b*: side surface
12: seal fin
12A: first seal fin
12B: second seal fin
12C: third seal fin
13: small clearance
13A: small clearance
13B: small clearance
13C: small clearance
14: widened section
15: dead water region-filling section
16: widened section
17: dead water region-filling section
18: widened section
19: dead water region-filling section
20: regulating valve
21: regulating valve chamber
22: valve body
23: valve seat
24: steam chamber
30: shaft body (structure)
301: annular groove
301*a*: bottom surface
301*b*: side surface
301*c*: stepped surface
31: shaft main body
32: disc
40: annular turbine vane group (blade)
41: turbine vane
42: hub shroud
42A: angled section
42*a*: outer circumferential surface
42*b*: axial direction end surface
50: annular turbine blade group (blade)
51: turbine blade
52: tip shroud
52A: angled section
52B: angled section
52C: angled section
521*a*: axial direction wall surface
521*b*: axial direction wall surface
521*c*: axial direction wall surface
522*a*: radial direction wall surface
522*b*: radial direction wall surface
522*c*: radial direction wall surface
60: bearing
61: journal bearing apparatus
62: thrust bearing apparatus
70: dead water region-filling section
71: dead water region-filling section
72: dead water region-filling section
73: dead water region-filling section
74: dead water region-filling section
75: dead water region-filling section
76: dead water region-filling section
77: dead water region-filling section
78: dead water region-filling section
79: dead water region-filling section
80: dead water region-filling section
81: dead water region-filling section
82: dead water region-filling section
83: dead water region-filling section
84: seal fin
84A: first seal fin
84B: second seal fin
84C: third seal fin
85: small clearance

85A: small clearance
85B: small clearance
85C: small clearance
86: dead water region-filling section
87: dead water region-filling section
88: dead water region-filling section
89: stepped section
90: widened section
91: stepped section
92: widened section
93: first seal fin
931: fin body section
932: space limiting section
94: widened section
95: dead water region-filling section
96: widened section
97: widened section
98: widened section
99: dead water region-filling section
C: cavity
C1: first cavity
C10: tenth cavity
C11: eleventh cavity
C12: twelfth cavity
C2: second cavity
C3: third cavity
C4: fourth cavity
C5: fifth cavity
C6: sixth cavity
C7: seventh cavity
C8: eighth cavity
C9: ninth cavity
HU1: separation vortex
HU2: separation vortex
HU3: separation vortex
HU4: separation vortex
HU5: separation vortex
K: inclined surface
K1: inclined surface
K2: inclined surface
S: steam
SU1: main vortex
SU2: main vortex
SU3: main vortex
SU4: main vortex
SU5: main vortex
SU6: main vortex
SU7: main vortex

The invention claimed is:

1. A turbine comprising:

a shaft body;

a turbine blade fixed to the shaft body and disposed on a flow path through which a fluid flows;

a tip shroud formed at a tip of the turbine blade;

a structure; and a plurality of turbine blade side seal fins protruded from the structure, wherein:

the structure is located close to the tip shroud so that a space is provided between the tip shroud and the plurality of turbine blade side seal fins, the plurality of turbine blade side seal fins are configured to form small clearances which are provided between the tip shroud and the plurality of turbine blade side seal fins, the tip shroud has a stepped part in cross section, the plurality of turbine blade side seal fins correspond to stages of the tip shroud, dead water region-filling sections are formed in spaces defined by the tip shroud, the structure, and the plurality of turbine blade side seal fins and in which a vortex flow of the fluid is generated, such that dead water regions that the vortex flow cannot reach are filled, the dead water region-filling sections are formed in both of a first corner of each of the spaces and a second corner of each of the spaces, the first corner of each of the spaces is formed by a first axial direction wall surface disposed on an upstream side along an axial direction of the turbine blade and a radial direction wall surface disposed along a radial direction of the turbine blade, the radial direction wall surface is connected between the first axial direction wall surface and a second axial direction wall surface disposed closer to a structure side than the first axial direction wall surface and disposed on a downstream side, the first corner of each of the spaces is continuously formed between the first axial direction wall surface and the second axial direction wall surface, and the second corner of each of the spaces is formed by the structure and a surface facing toward an upstream side of one of the plurality of turbine blade side seal fins opposed to the second axial direction wall surface.

2. The turbine according to claim 1, wherein the dead water region-filling sections have inclined surfaces along the vortex flow of the fluid.

3. The turbine according to claim 2, wherein the inclined surfaces are formed in concave-shaped curves in a cross section in an axial direction thereof.

4. The turbine according to claim 2, wherein the inclined surfaces are formed in substantially linear shapes in a cross section in an axial direction thereof.

5. The turbine according claim 3, wherein:

the dead water region-filling sections include the first corner of each of the spaces and the second corner of each of the spaces, the inclined surfaces of the dead water region-filling sections of the first corner of each of the spaces and the second corner of each of the spaces have a shape of a curve of an oval, and the shape of the curve of the oval of the first corner of each of the spaces is elongated in the radial direction, and the shape of the curve of the oval of the second corner of each of the spaces is elongated in the axial direction.

6. The turbine according to claim 1, wherein the plurality of turbine blade side seal fins are formed at downstream sides of the radial direction wall surfaces of the stages of the tip shroud.

7. The turbine according to claim 1, further comprising:

a casing;

a turbine vane held in the casing;

a hub shroud formed at a tip of the turbine vane; and a plurality of turbine vane side seal fins protruded from the hub shroud and configured to form small clearances which are provided between the shaft body and the plurality of turbine vane side seal fins, wherein, among the plurality of turbine vane side seal fins, a first turbine vane side seal fin formed at a furthest upstream side in an axial direction is disposed on a same surface as an upstream end surface disposed at the furthest upstream side in the axial direction of the hub shroud.

8. The turbine according to claim 7, wherein an axial direction wall surface in an axial direction of the shaft body steps down in a radial direction at an upstream side of the first turbine vane side seal fin.

9. The turbine according to claim 7, wherein an axial direction wall surface in an axial direction of the shaft body has a step difference in a radial direction between adjacent ones of the plurality of turbine vane side seal fins.

10. The turbine according to claim 7, wherein dead water region-filling sections are formed in spaces defined by the hub shroud, the structure, and the plurality of turbine vane side seal fins and in which an additional vortex flow of the fluid is generated, such that dead water regions that the additional vortex flow cannot reach are filled.

11. The turbine according to claim 8, wherein dead water region-filling sections are formed in spaces defined by the hub shroud, the structure, and the plurality of turbine vane side seal fins and in which an additional vortex flow of the fluid is generated, such that dead water regions that the additional vortex flow cannot reach are filled.

12. The turbine according to claim 9, wherein dead water region-filling sections are formed in spaces defined by the hub shroud, the structure, and the plurality of turbine vane side seal fins and in which an additional vortex flow of the fluid is generated, such that dead water regions that the additional vortex flow cannot reach are filled.

13. The turbine according to claim 1, wherein:

the tip shroud has a stepped part in cross section in a flow direction of steam, such that small clearances which are provided between the tip shroud and the structure are reduced, and the plurality of turbine blade side seal fins have reduced lengths, such that the plurality of turbine blade side seal fins correspond to the stages of the tip shroud.

* * * * *